US010160230B2

(12) United States Patent
Ernst et al.

(10) Patent No.: US 10,160,230 B2
(45) Date of Patent: Dec. 25, 2018

(54) PRINTING SYSTEM FOR APPAREL

(71) Applicant: NIKE, Inc., Beaverton, OR (US)

(72) Inventors: Travis K. Ernst, Portland, OR (US); Christopher L. Andon, Portland, OR (US); Joseph J. Bevier, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 40 days.

(21) Appl. No.: 14/723,756

(22) Filed: May 28, 2015

(65) Prior Publication Data

US 2016/0347086 A1 Dec. 1, 2016

(51) Int. Cl.

| | |
|---|---|
| ***B41J 2/165*** | (2006.01) |
| ***B41J 3/407*** | (2006.01) |
| ***B41J 11/04*** | (2006.01) |
| ***D06B 23/04*** | (2006.01) |
| *D06B 11/00* | (2006.01) |

(52) U.S. Cl.

CPC ..... *B41J 3/4078* (2013.01); *B41J 11/04* (2013.01); *D06B 23/04* (2013.01); *D06B 11/0073* (2013.01)

(58) Field of Classification Search

None

See application file for complete search history.

(56) References Cited

U.S. PATENT DOCUMENTS

| | | | | |
|---|---|---|---|---|
| 2,249,939 | A * | 7/1941 | Branan | B41F 17/38 101/38.1 |
| 4,235,101 | A | 11/1980 | Stadelmann | |
| 4,838,982 | A * | 6/1989 | Klaeser | B31B 1/90 156/520 |
| 5,548,995 | A | 8/1996 | Clinton et al. | |
| 5,819,658 | A | 10/1998 | Bornhorst, Jr. | |
| 5,831,641 | A * | 11/1998 | Carlson | B41J 3/4073 141/1 |
| 7,076,361 | B2 | 7/2006 | Wang et al. | |
| 7,367,264 | B2 * | 5/2008 | Beaudry | B41F 13/18 101/246 |
| 7,658,146 | B2 | 2/2010 | Reinholdt | |
| 8,511,782 | B2 | 8/2013 | Chang et al. | |
| 9,078,796 | B1 * | 7/2015 | Hall | A61G 5/14 |
| 2008/0236417 | A1 | 10/2008 | Coffinardi et al. | |
| 2010/0039487 | A1 | 2/2010 | Sawatsky | |
| 2010/0264197 | A1 * | 10/2010 | Aoyama | B23K 1/08 228/219 |
| 2012/0274695 | A1 | 11/2012 | LaCaze et al. | |

FOREIGN PATENT DOCUMENTS

| | | | |
|---|---|---|---|
| DE | 4424528 | A1 | 1/1996 |

* cited by examiner

*Primary Examiner* — Alejandro Valencia

(74) *Attorney, Agent, or Firm* — Klarquist Sparkman, LLP

(57) ABSTRACT

A printing system for an article of apparel includes an article receptacle device for receiving an article to be printed. The printing system includes a receptacle receiving system for receiving an article receptacle device with an article to be printed. The printing system can include an article positioning system for positioning an article receptacle device with an article to be printed. The printing system can include a printhead for printing an indicia portion on an article that corresponds to a design element on the article.

8 Claims, 21 Drawing Sheets

PRINTING SYSTEM FOR APPAREL

BACKGROUND

The present embodiments relate generally to printing systems and in particular to printing systems that can be used to print to apparel.

Printing systems may utilize various components such as a printing device. The printing device can include a printhead, as well as ink cartridges to supply ink to the printhead.

BRIEF DESCRIPTION OF DRAWINGS

The embodiments can be better understood with reference to the following drawings and descriptions. The components in the figures are not necessarily to scale, emphasis instead being placed upon illustrating the principles of the embodiments. Moreover, in the figures, like reference numerals designate corresponding parts throughout the different views.

DETAILED DESCRIPTION OF DRAWINGS

Figure 1:
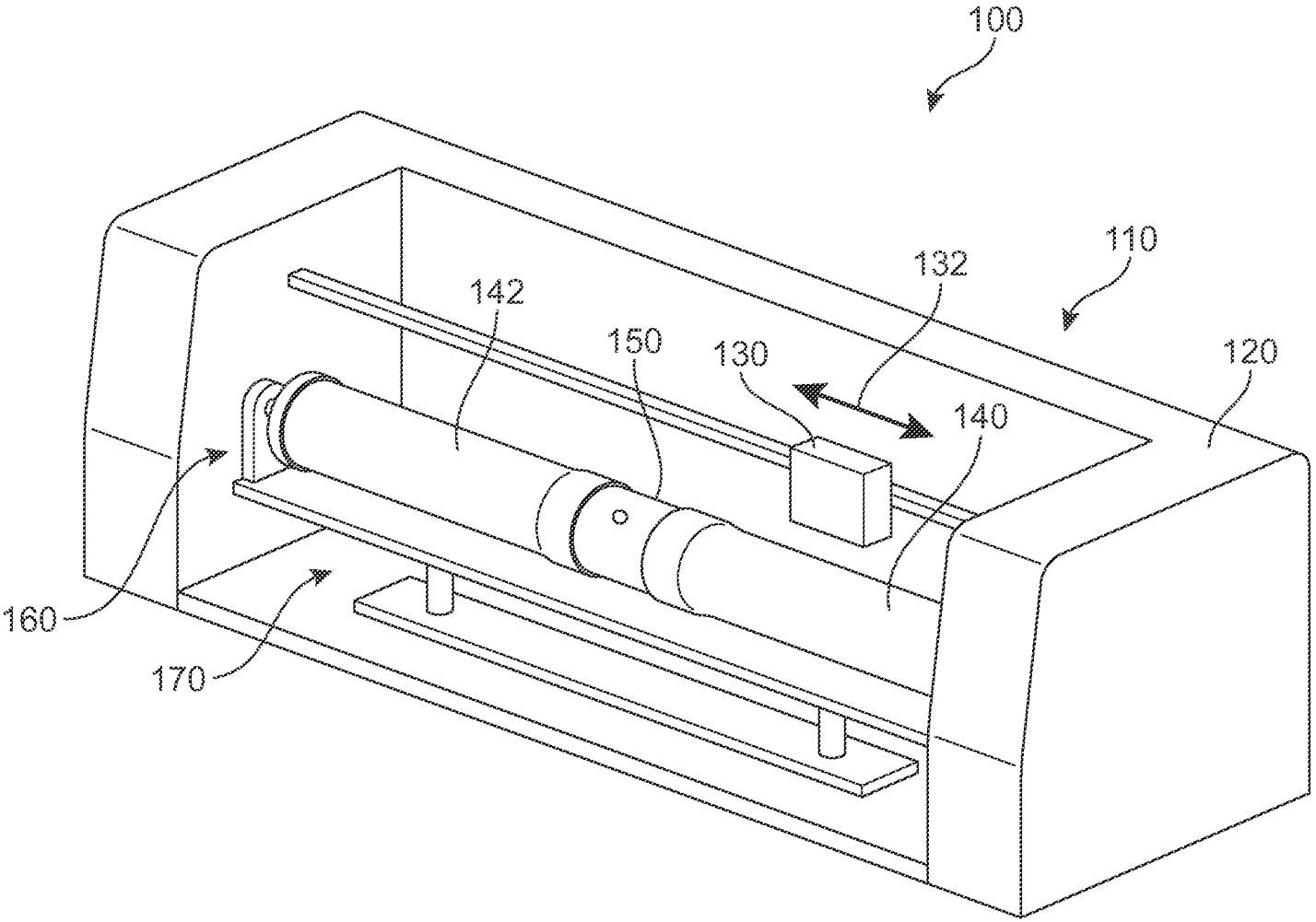
FIG. 1 is schematic view of an embodiment of a printing system.

In one aspect, the embodiments provide a printing system for printing onto an article of apparel and includes an article receptacle device configured to receive an article of apparel, and a printhead displaceable along a longitudinal axis. The article positioning member is configured to articulate the receptacle receiving frame along a vertical axis, perpendicular to the longitudinal axis, thereby allowing a distance between the article of apparel and the printhead to be varied. The printhead is configured to apply ink to the article of apparel on the article receptacle device.

In another aspect, the embodiments provide a printing system for printing onto an article of apparel and includes an article receptacle device configured to receive an article of apparel, a receptacle receiving system configured to receive the article receptacle device, an article positioning system configured to move the receptacle receiving system, and a printhead displaceable along a longitudinal axis. The article receptacle device includes a receptacle end configured to receive a circumferential positioning member. The circumferential positioning member includes an alignment positioning portion. The receptacle receiving system includes a receptacle positioning member attached to a receptacle receiving frame, where the receptacle positioning member includes an alignment receiving portion. The alignment receiving portion is coupled with the alignment positioning portion for registration between the article receptacle device and the receptacle receiving system. The coupling between the alignment positioning portion and alignment receiving portion enables the article receptacle device to be rotated about a rotational direction.

In another aspect, the embodiments provide a printing system for printing comprising an article receptacle device configured to receive an article of apparel, and a printhead displaceable along a longitudinal axis. The article receptacle device has a first receptacle end and a second receptacle end. The article positioning system can move the article receptacle device between a horizontal configuration and a tilted configuration. The first receptacle end and the second receptacle end have a same vertical position along the vertical axis in the horizontal configuration, and a different vertical position along the vertical axis in the tilted configuration.

In another aspect, the embodiments provide a method of operating a printing system for printing onto an article of apparel. The method includes placing an article of apparel onto an article receptacle device. The method also includes positioning the article receptacle device onto the printing system, where the printing system receives information related to a thickness of the article of apparel. The method also includes dispersing an ink from the printhead onto a surface of the article of apparel. The method also includes determining if the printhead may contact a target portion of the article of apparel using the information related to the thickness of the article of apparel and tilting the article receptacle device to avoid contact between the printhead and the target portion of the article of apparel.

Other systems, methods, features and advantages of the embodiments will be, or will become, apparent to one of ordinary skill in the art upon examination of the following figures and detailed description. It is intended that all such additional systems, methods, features and advantages be included within this description and this summary, be within the scope of the embodiments, and be protected by the following claims.

FIG. 1 illustrates a schematic view of an embodiment of a printing system 100. In some embodiments, printing system 100 may include a print assembly system 110, including a printing system housing portion 120. In some embodiments, printing system housing portion 120 may be used to house other components, devices, or systems of printing system 100. For example, printing system housing portion 120 may retain at least one printhead 130, a receptacle receiving system 160, and an article positioning system 170. For purposes of illustration, only some components of printing system 100 are shown in FIG. 1 and described below. It will be understood that in other embodiments printing system 100 may include additional provisions.

In some embodiments, printhead 130 disperses ink onto an article and is displaceable along a longitudinal direction or longitudinal axis 132. In other embodiments, it is contemplated that printhead 130 could be translated in one or more directions that are perpendicular to longitudinal axis 132 as well. In some cases, longitudinal axis 132 may generally extend along a longest dimension of printing system 100. For purposes of illustration, a single printhead is shown in FIG. 1, however other embodiments could utilize one, two, three, or more than three different printheads.

Printing system 100 may utilize various types of printing techniques. These can include, but are not limited to: toner-based printing, liquid inkjet printing, solid ink printing, dye-sublimation printing, inkless printing (including thermal printing and UV printing), MEMS jet printing technologies as well as any other methods of printing. In some cases, printing system 100 may make use of a combination of two or more different printing techniques. The type of printing technique used may vary according to factors including, but not limited to: material of the target article, size and/or geometry of the target article, desired properties of the printed image (such as durability, color, ink density, etc.) as well as printing speed, printing costs and maintenance requirements.

In some embodiments, printing system 100 may be associated with an article of apparel, also referred to simply as article 140. In some embodiments however, printing system 100 need not be limited to use with articles of apparel and the principles taught throughout this detailed description may be applied to additional articles as well. Generally, these principles could be applied to any article that may be worn. In some embodiments, the article may include one or more articulated portions that are configured to move. In other cases, the article may be configured to conform to portions of a wearer in a three-dimensional manner. Examples of articles that are configured to be worn include, but are not limited to: footwear, gloves, shirts, pants, socks, scarves, hats, jackets, as well as other articles. Other examples of articles include, but are not limited to: shin guards, knee pads, elbow pads, shoulder pads, as well as any other type of protective equipment. Additionally, in some embodiments, the article could be another type of article that is not configured to be worn, including, but not limited to: balls, bags, purses, backpacks, as well as other articles that may not be worn In some embodiments printing system 100, may include provisions to secure an article 140 for printing. In some embodiments, provisions may include an article receptacle device 150. In some other embodiments, article receptacle device 150 may load more than one article. As shown in FIG. 1, article receptacle device 150 may also load a second article 142.

Printing system 100 may include features to secure other components in place relative to printing system housing portion 120. In some embodiments, receptacle receiving system 160 may be used to receive article receptacle device 150 onto printing system housing portion 120. In some other embodiments, article positioning system 170 may be used to position the article receptacle device 150 variable distances from the printhead 130.

Figure 2:
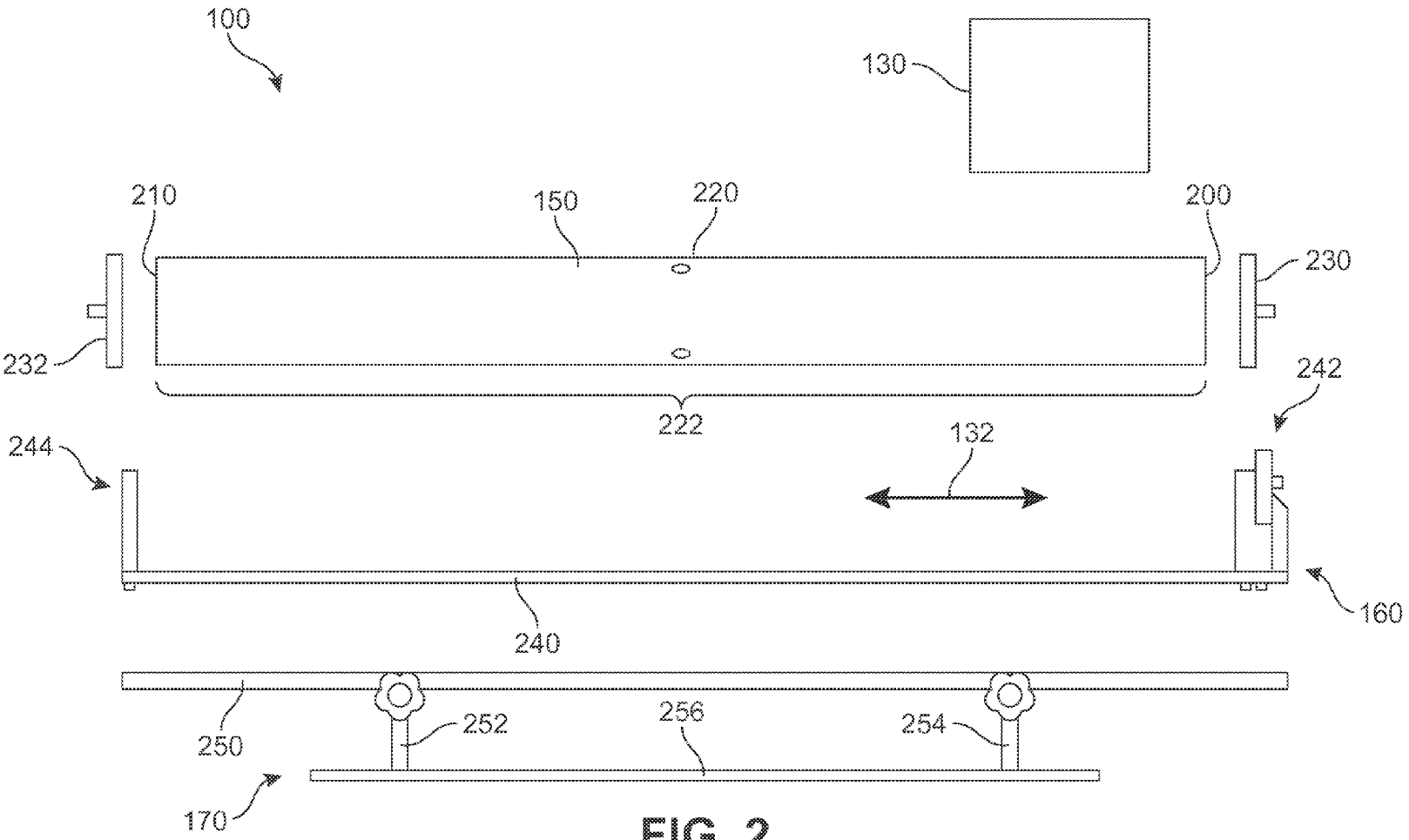
FIG. 2 is an exploded front view of an embodiment of a printing system.

FIG. 2 depicts an exploded view of some components of a printing system 100. In some embodiments, printing system 100 may include provisions for receiving a plurality of articles or a singular article to be printed. As previously stated, in some embodiments, an article receptacle device 150 can be used for loading articles onto printing system 100.

In some embodiments, article receptacle device 150, may include a first receptacle end 200, a second receptacle end 210, and a receptacle midpoint 220. In some cases, article receptacle device 150 may be dimensioned along a set of axes. For example, article receptacle device 150 may have a longitudinal length 222, running lengthwise along longitudinal axis 132 and disposed between first receptacle end 200 and second receptacle end 210. In some embodiments, receptacle midpoint 220 may demarcate the middle of the article receptacle device 150 wherein first receptacle end 200 and second receptacle end 210 are equidistant. In some embodiments, article receptacle device 150 may have more receptacle ends. In some other embodiments, article receptacle device 150 may have fewer receptacle ends.

In some cases, printing system 100 may include provisions to secure an article onto an article receptacle device 150 for printing. As shown in FIG. 2, in some embodiments, a first article (not shown) may be secured to article receptacle device 150 at first receptacle end 200 with a circumferential positioning member 230. In some other embodiments, a second article (not shown) may be secured to article receptacle device 150 at second receptacle end 210 with a second circumferential positioning member 232. In some embodiments, only a first circumferential positioning member 230 may be used. In those embodiments utilizing only a first circumferential positioning member 230, a simple end cap (not shown) may be used at second receptacle end 210 to secure an article to article receptacle device 150.

In some embodiments, printing system 100 may include provisions to receive article receptacle device 150 having an article to be printed. In some embodiments, provisions may include a receptacle receiving system 160 to receive the article receptacle device 150 to printing system 100 to facilitate printing. In some cases, receptacle receiving system 160 may include a receptacle receiving frame 240.

In some cases, article receptacle device 150 may be placed onto a receptacle receiving frame 240 for printing. In different embodiments, the geometry of receptacle receiving frame 240 can vary. In some cases, receptacle receiving frame 240 may have a substantially linear geometry. In some other embodiments, receptacle receiving frame 240 may have a non-linear geometry.

In some embodiments, receptacle receiving system 160 may include features to secure the article receptacle device 150 onto the receptacle receiving frame 240. In some embodiments, a receptacle positioning member 242 may be used to secure at least one end of an article receptacle device 150 with a 230 onto receptacle receiving frame 240. In some other embodiments, a receptacle receiving member 244 may be used to secure a second end of article receptacle device 150 onto receptacle receiving frame 240.

In some embodiments, printing system 100 may include provisions to move article receptacle device 150 with an article closer to or farther away from a printhead 130 during operation. In some embodiments, provisions may include an article positioning system 170.

In some cases, article positioning system 170 may have an article positioning device 250. In some embodiments, article positioning device 250 may be used to facilitate the movement of receptacle receiving frame 240. In some embodiments, receptacle receiving frame 240 may overly article positioning device 250.

In some embodiments, an article positioning system 170 may include a first article positioning member 252. First article positioning member 252 may be used to enable movement of article positioning device 250 in a linear direction perpendicular to longitudinal axis 132. In some embodiments, a second article positioning member 254 may be included to enable movement of article positioning device 250 in a linear direction independent from first article positioning member 252. In some cases, first article positioning member 252 and second article positioning member 254 may be attached to article positioning device 250. In some other embodiments, article positioning device 250 may be absent, and first article positioning member 252 and second article positioning member 254 may be directly attached to receptacle receiving frame 240.

In some embodiments, article positioning system 170 may also include an article positioning base 256. Article positioning base 256 may be placed underneath first article positioning member 252 and/or second article positioning member 254 for increased stability during printing operation.

Figure 3:
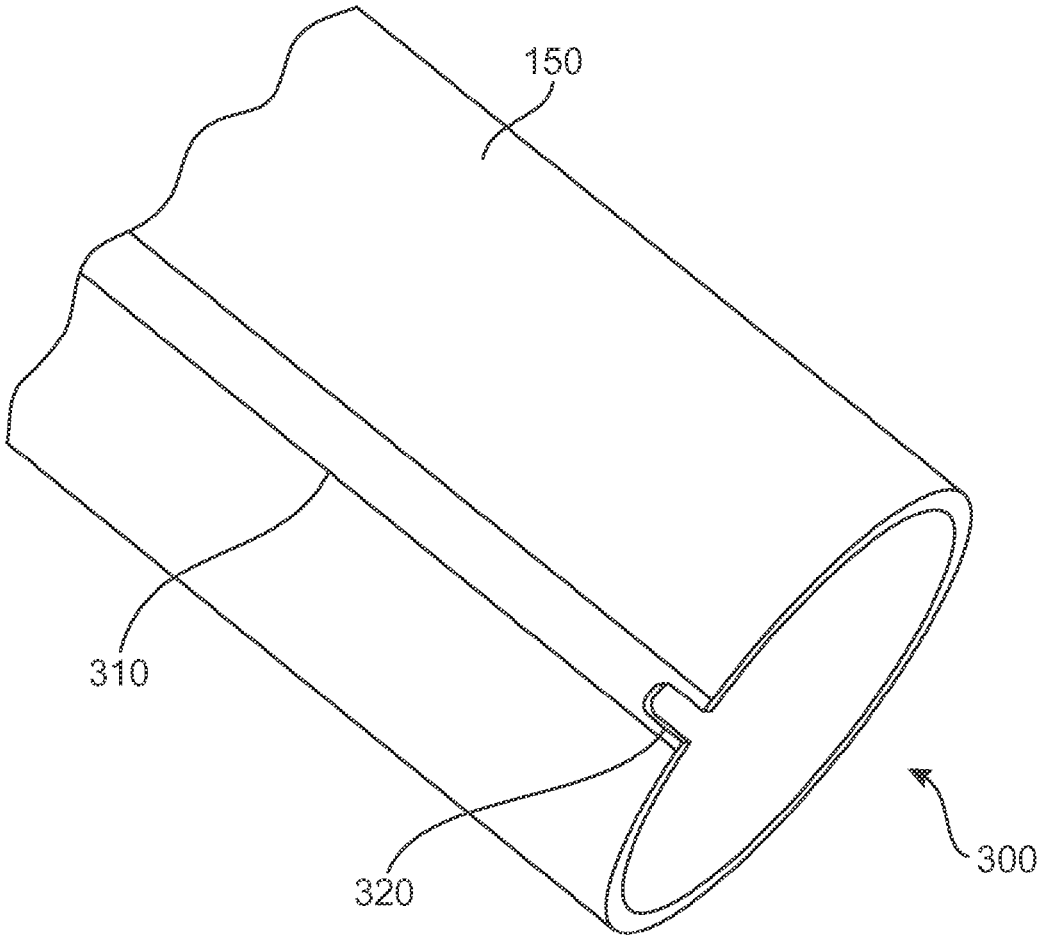
FIG. 3 is a partial schematic view of an embodiment of an article receptacle device.

As stated previously, in some cases, an article can be held with the use of an article receptacle device 150. FIG. 3 depicts a partial schematic view of an article receptacle device 150 that may hold an article to be printed.

In some embodiments, article receptacle device 150 may be substantially cylindrical in shape. In those embodiments having an article receptacle device 150 with a substantially cylindrical shape, the cross-section of the article receptacle device 150 may be substantially circular. However, other embodiments may utilize article receptacle device 150 having other kinds of cross-sectional shapes including rectangular, triangular, regular, irregular, as well as any other kinds of cross-sectional shapes. Moreover, in the exemplary embodiment of FIG. 3, article receptacle device 150 may be substantially hollow. However, in other embodiments, article receptacle device 150 may not be hollow.

In some embodiments, article receptacle device 150, having a substantially cylindrical geometry, may receive an article with a substantially tubular geometry, such as a sock (not shown). In some embodiments, when a sock (not shown) is placed at a first receptacle end 300 and mounted onto article receptacle device 150, the sock may conform to the cylindrical shape of the article receptacle device 150.

Some devices for holding an article for printing may include provisions for centering or aligning an article loaded on the device. In some embodiments, these provisions facilitate printing at correct locations of an article. In an exemplary embodiment, article receptacle device 150 may include an alignment guide 310 axially aligned for centering or positioning an article in a known position. For example, the alignment guide 310 may be used to reference a front side of an article, such as a sock, when mounted on the article receptacle device 150. Printing system 100 will then have a point or points of reference for printing on the article. In some cases, article receptacle device 150 may include multiple alignment guides. In some other cases, alignment guide 310 may be absent.

In some embodiments, printing system 100 may include provisions to ensure an article is in a known position when mounted on article receptacle device 150. In some embodiments, article receptacle device 150 may include notch member 320 for facilitating accurate printing on an article. In some cases, article receptacle device 150 may include multiple notch members. In some other cases, notch member 320 may be absent. The utility of notch member 320 in facilitating desired alignment between components is discussed below.

In some embodiments, printing system 100 may include other provisions for the precise alignment and placement of printed portions on an article, also known as registration. In some embodiments, it may be useful to provide a user with a way of aligning an article with a printing system 100 to ensure printed information is printed in the desired portions of the article.

Figure 4:
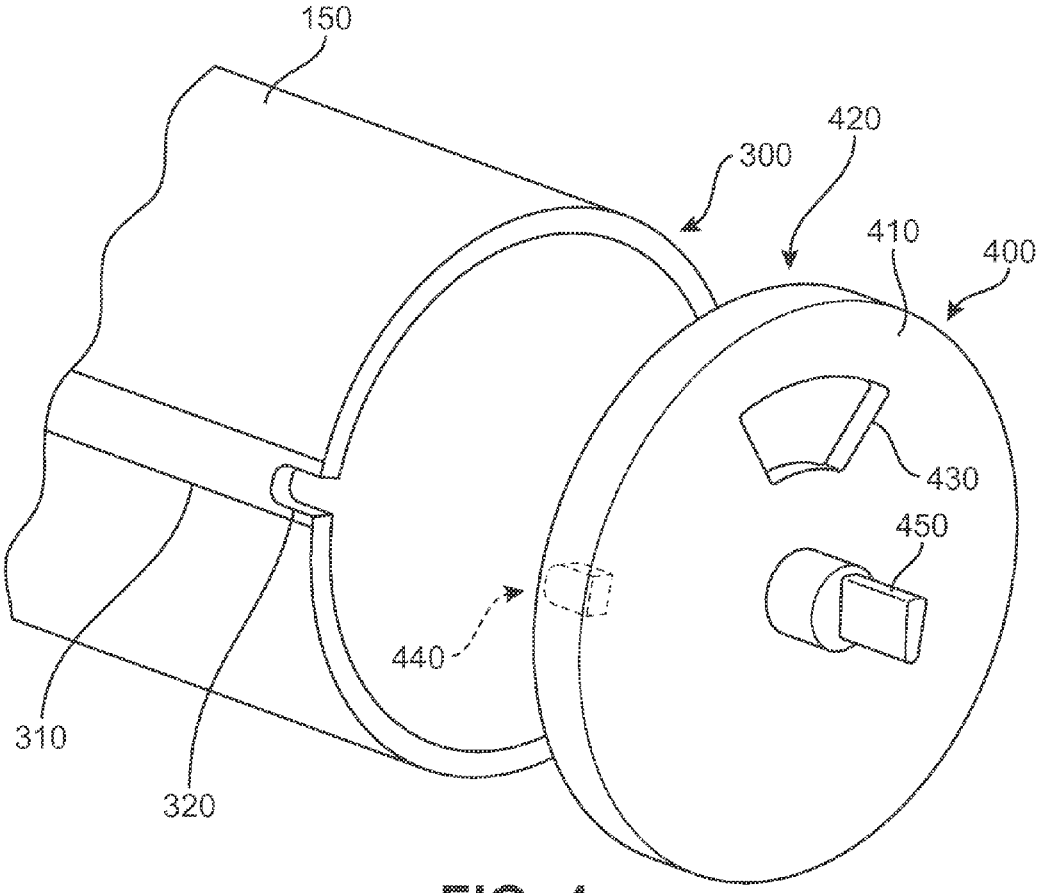
FIG. 4 is a partial schematic view of an embodiment of a circumferential positioning member configured with an article receptacle device.

As shown in FIG. 4, registration provisions may include a circumferential positioning member 400 configured with article receptacle device 150 for accurate registration. In some embodiments, circumferential positioning member 400 may include a first surface 410, and a second surface 420 opposite first surface 410. In some cases, circumferential positioning member 400 may be substantially solid, or include openings 430. In some embodiments, circumferential positioning member 400 may be placed over first receptacle end 300 to secure an article onto article receptacle device 150.

In some cases, circumferential positioning member 400 may include a mating tab portion 440, depicted in phantom lines for purposes of illustration. In some embodiments, mating tab portion 440 may be configured for notch member 320 of article receptacle device 150. Therefore, when mating tab portion 440 is secured to notch member 320, a known and fixed angular alignment between circumferential positioning member 400 and article receptacle device 150 may be achieved.

Some embodiments may include provisions for facilitating the rotation of the article receptacle device 150 during printing operations. In some embodiments, provisions include an alignment positioning portion 450 that may enable the rotation of article receptacle device 150. In some cases, alignment positioning portion 450 may be a shaft-like structure. More specifically, in some embodiments, alignment positioning portion 450 may be somewhat flattened with an approximately wedge-like cross-sectional shape. In some cases, this approximately wedge-like cross sectional geometry may define a particular orientation at which alignment positioning portion 450 may engage with a corresponding structure bringing them into axial alignment with each other. In some other embodiment, alignment positioning portion 450 may have a different geometric structure.

In some embodiments, printing system 100 may include provisions to facilitate printing onto articles disposed on article receptacle device 150, including articles such as socks, having curved and/or non-planar geometries. In some embodiments, printing system 100 may include provisions to rotate article receptacle device 150 so that ink may be dispersed over any portion of an underlying article, including portions having any angular or circumferential positions with respect to a central axis of article receptacle device 150.

In some embodiments, a receptacle receiving system 160 can be used to facilitate the rotation of article receptacle device.

Figure 5:
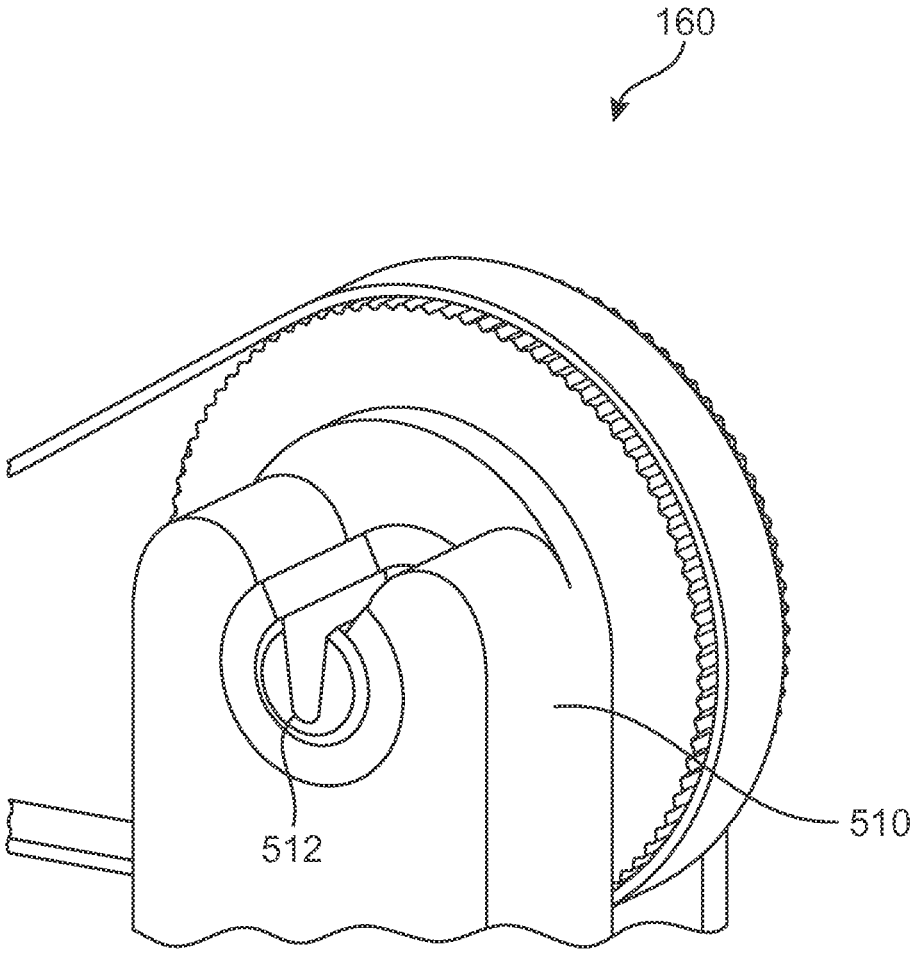
FIG. 5 is a partial schematic view an embodiment of a receptacle receiving system with receptacle positioning member.

FIG. 5 illustrates an exemplary receptacle receiving system 160 to facilitate printing of an article with a curved geometric surface. In some embodiments, receptacle receiving system 160 may include devices to receive and rotate an article receptacle device 150. In some embodiments, the receptacle receiving system 160 may include devices having an aperture or a slot structure. The slot structure may be used to obtain a fixed and known alignment between receptacle receiving system 160 and article receptacle device 150 when connected. In some cases, such devices may include a receptacle positioning member 510. In an exemplary embodiment, receptacle positioning member 510 may include an alignment receiving portion 512 dimensioned to receive and connect with alignment positioning portion 450 on circumferential positioning member 400 (as shown, for example, in FIG. 4).

In embodiments where alignment positioning portion 450 has an approximately wedge-like geometry, alignment receiving portion 512 could include a corresponding wedge-like opening or slot to receive alignment positioning portion 450. In at least some embodiments, the approximately wedge-like geometry of alignment positioning portion 450 and corresponding geometry of alignment receiving portion 512 ensures that article receptacle device 150 can only be attached to receptacle receiving system 160 at a singular position. Of course, in other embodiments other geometries for alignment positioning portion 450 and alignment receiving portion 512 could be utilized to achieve a similar unique and angular position for attaching article receptacle device 150 to receptacle receiving system 160 in order to facilitate alignment of the printing system with an article. Moreover, still other embodiments could utilize geometries that allow article receptacle device 150 to be attached at more than one unique angular position.

Figure 6:
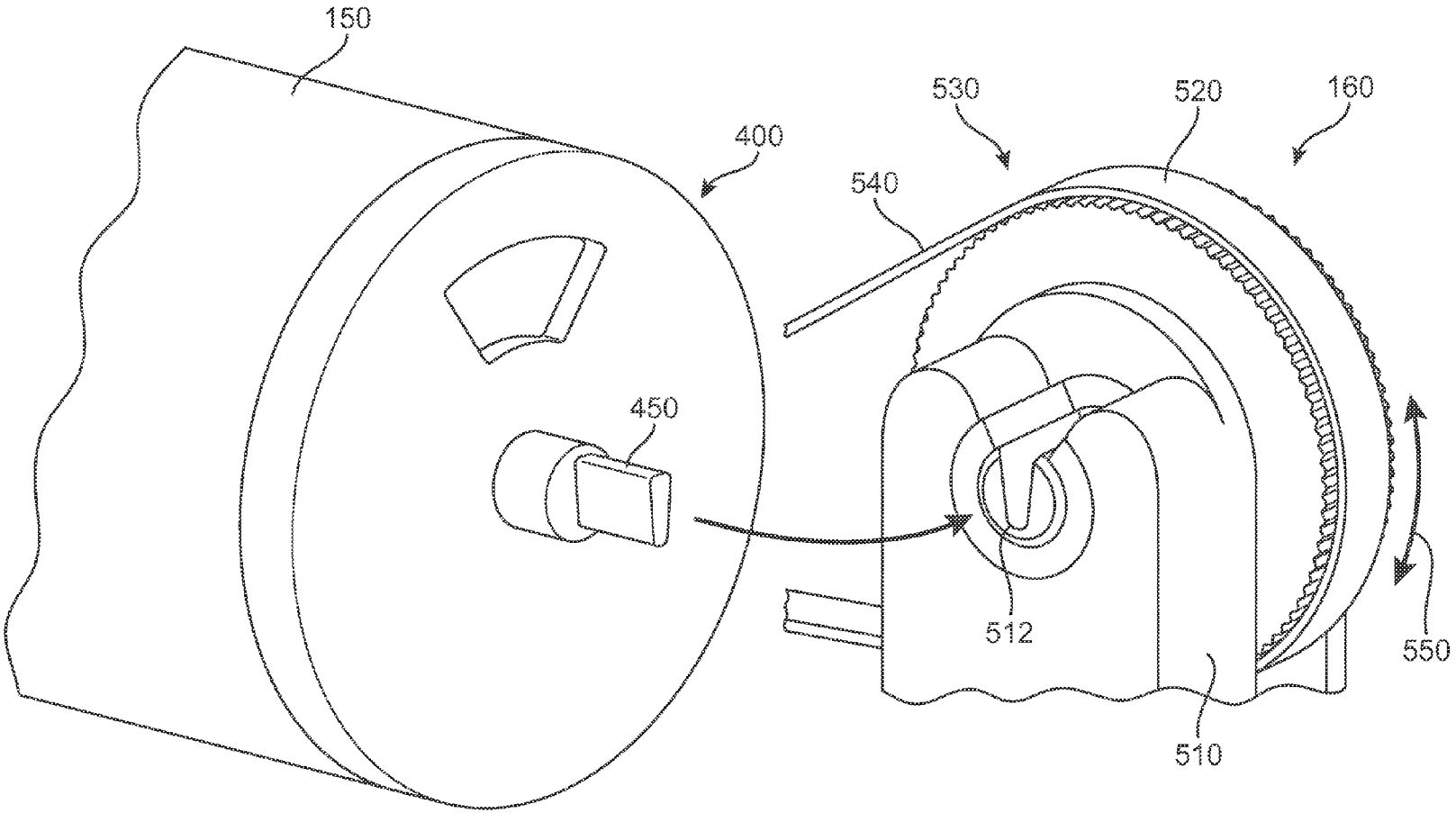
FIG. 6 is a partial schematic view of an embodiment of a receptacle receiving system configured to receive the article receptacle device and circumferential positioning member.

As illustrated in FIG. 6, in some embodiments, the connection of the receptacle positioning member 510 with the circumferential positioning member 400 creates a coupling and supports the rotation of article receptacle device 150 about a rotational direction 550. More specifically, rotational direction 550 corresponds to the rotational direction along a central axis of article receptacle device 150 through which article receptacle device 150, and any article disposed on article receptacle device 150, may rotate. In some cases, rotational direction 550 may be defined about a central longitudinal axis of article receptacle device 150. However, in other cases, rotational direction 550 could be defined about the central axis of another component, such as receptacle positioning member 510.

In some embodiments, the connection between circumferential positioning member 400 and receptacle positioning member 510 also supports the registration between article receptacle device 150 and components of receptacle receiving system 160, for continuous printing of an article having a non-planar surface. In some other embodiments, the connection further defines an angular orientation about alignment receiving portion 512 for use as a reference point during the printing process.

As depicted in FIG. 6 receptacle positioning member 510 including alignment receiving portion 512 with a slotted structure, may receive circumferential positioning member 400 comprising alignment positioning portion 450 with a shaft-like structure. In an exemplary embodiment, when alignment positioning portion 450 is coupled with alignment receiving portion 512, the connection results in an initial or first angular position having a zero degree angle. Thus, when a torque is applied, alignment receiving portion 512 may then rotate about rotational direction 550, and adjust the angular position of alignment receiving portion 512 and alignment positioning portion 450 (with article receptacle device 150) from its first angular position of 0 degrees to a second angular position. Therefore, in some embodiments, an angular alignment between the alignment receiving portion 512 and alignment positioning portion 450 is known providing a reference for printhead registration during operation.

In some embodiments, the rotation of article receptacle device 150 and circumferential positioning member 400 connected to receptacle positioning member 510 may be controlled automatically using any motorized system known in the art. In an exemplary embodiment, a drive pulley 520 may be coupled to a motor system 530 and engaged with a driven pulley (not shown) by a drive belt 540 to support the rotation of article receptacle device 150 during printing operations.

In some embodiments, printing system 100 may include provisions for determining a known position along the circumference of a circumferential positioning member 400, and correspondingly the rotational position of the receptacle positioning member 510. In some cases, by using this predetermined circumferential position of a circumferential positioning member 400 and the rotational position of the receptacle positioning member 510, accurate registration between an article mounted onto the article receptacle device 150 and components of the printing system 100 can be achieved.

In some embodiments, a position sensor system (not shown) can be used to determine a circumferential position on a circumferential positioning member 400, and the rotational position of the receptacle positioning member 510. Such a positioning sensor system allows for proper placement of printed information on an article. In some embodiments, a position sensor system similar to crank angle sensor systems used in internal combustion engines could be used. Examples of engine crank angle sensor systems are disclosed in U.S. Pat. No. 4,235,101 to Stadelmann; U.S. Pat. No. 5,548,995 to Allen et al.; and U.S. Pat. No. 7,076,361 to Wang et al., each of which is hereby incorporated by reference in their entirety.

Embodiments can include provisions for printing to articles with geometries that are non-planar, curved, or otherwise irregular along a direction corresponding to the longitudinal axis of article receptacle device 150. For example, embodiments can include provisions for maintaining an approximately constant distance between printhead 130 and portions of an article beneath the printhead 130 even when the article's thickness and/or geometry varies.

In an exemplary embodiment, by adjusting the distance between an article and printhead 130, issues that may occur when trying to print on a three-dimensional article are minimized.

Some embodiments of printing system 100 may include provisions for moving an article mounted onto article receptacle device 150 proximate to or farther away from a print assembly system 110 with respect to a vertical axis perpendicular to longitudinal axis 132. In some embodiments, these provisions may include devices for vertically lifting and/or tilting article receptacle device 150 in order to adjust distances from printhead 130. In some printing systems 100, by adjusting the distance between printhead 130 and an article with varying thickness, printhead 130 travelling along a longitudinal axis 132 may avoid contacting the surface of article.

In some embodiments, article positioning system 170 may include mechanisms to facilitate the movement of receptacle receiving system 160 with article receptacle device 150. Some exemplary devices known in the art may include linear actuators enabling motion in a straight line, such as pistons, or rack and pinion devices. In some other exemplary embodiments, the devices may be a rotary actuator enabling movement in a circular motion.

Figure 7:
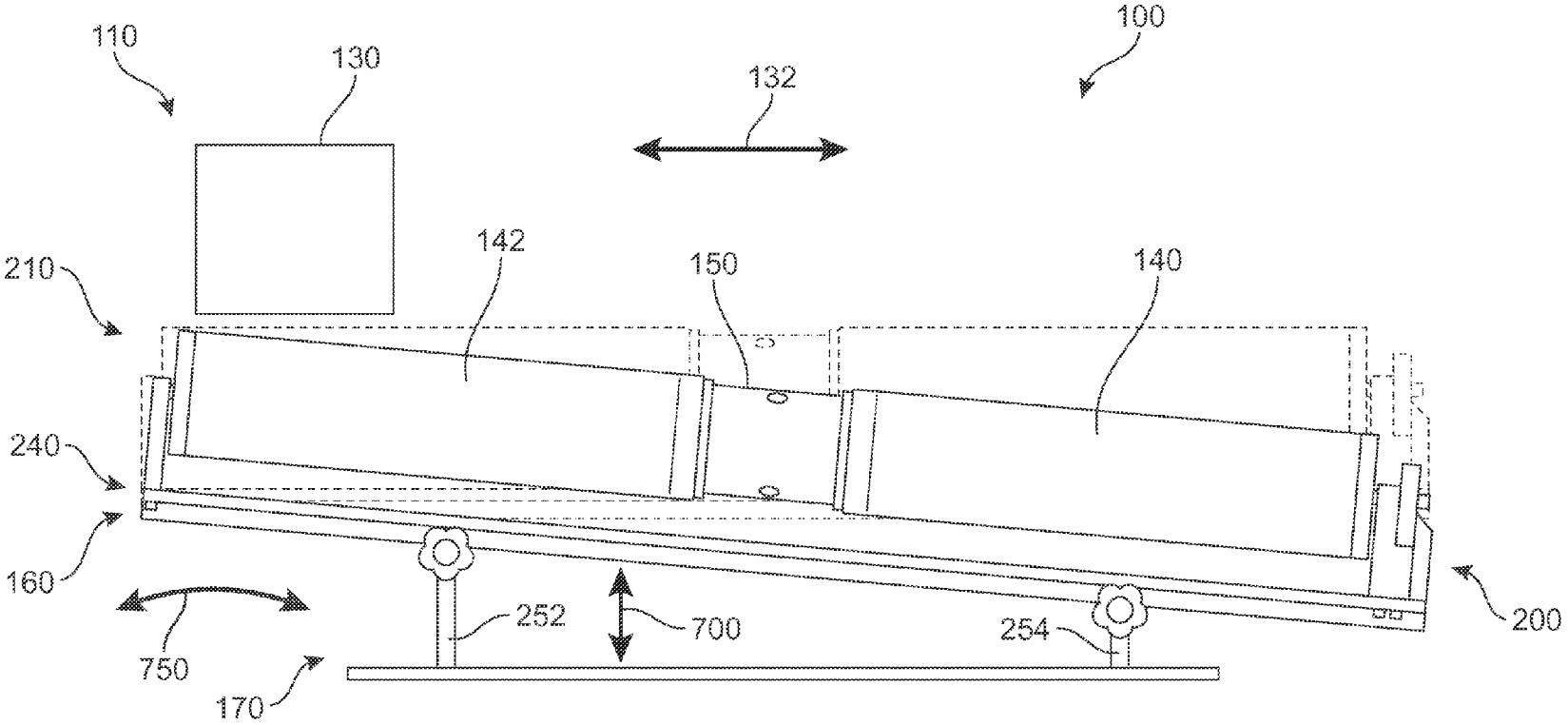
FIG. 7 is a front schematic view of an embodiment of a printing system during operation.

As illustrated in FIG. 7, an exemplary embodiment of printing system 100 may include an article positioning system 170. In some embodiments, article positioning system 170 may adjust a distance between printhead 130 and a plurality of articles including, but not limited to, first article 140 and/or second article 142, mounted onto an article receptacle device 150. In some cases this is accomplished by moving components of receptacle receiving system 160 including receptacle receiving frame 240. In some embodiments, article positioning system 170 may include at least a first article positioning member 252. As previously mentioned, in some cases, first article positioning member 252 may be a linear actuator. In some embodiments, first article positioning member 252 can move components of receptacle receiving system 160 having article receptacle device 150 with first article 140, and/or second article 142, in an up or down position along a vertical axis 700 that is perpendicular to longitudinal axis 132, and relative to printhead 130.

In some embodiments, article positioning system 170 may include a second article positioning member 254. In some cases, first article positioning member 252 and second article positioning member 254 may move article receptacle device 150 together simultaneously along vertical axis 700 such that article receptacle device is substantially horizontal during movement. In some other cases, first article positioning member 252 may move along vertical axis 700 independently from second article positioning member 254 such that article receptacle device 150 may tilt at an angle relative to longitudinal axis 132. In other words, article receptacle device 150 may be tilted along tilting direction 750 as first article positioning member 252 moves independently from second article positioning member 254. As used herein, the term "tilting direction" or "tilting motion" refers to a possible movement or motion of article receptacle device 150 (i.e. a degree of freedom or mode of movement) where first receptacle end 200 has a different vertical position (e.g., height or displacement) from second receptacle end 210. In some embodiments, second article positioning member 254 may be absent.

FIG. 7 depicts the ability of article positioning system 170 to actuate some of its components independently. Phantom lines depict a starting position, where article receptacle device 150 and article positioning system 170 are substantially horizontal. Article positioning system 170, and its components, first article positioning member 252 and second article positioning member 254, may subsequently reposition portions of receptacle receiving system 160 including receptacle receiving frame 240, and article receptacle device 150, such that second receptacle end 210 may be higher than first receptacle end 200 or vice versa.

By allowing the independent movement of first article positioning member 252 from second article positioning member 254, the article receptacle device 150 may be tilted at an angle relative to longitudinal axis 132. In some embodiments, a single article positioning member can be configured to adjust both the vertical position along vertical axis 700 and a tilting position along tilting direction 750 of article receptacle device 150, in other words a single article positioning member can be a linear actuator and a rotational actuator.

Figure 8:
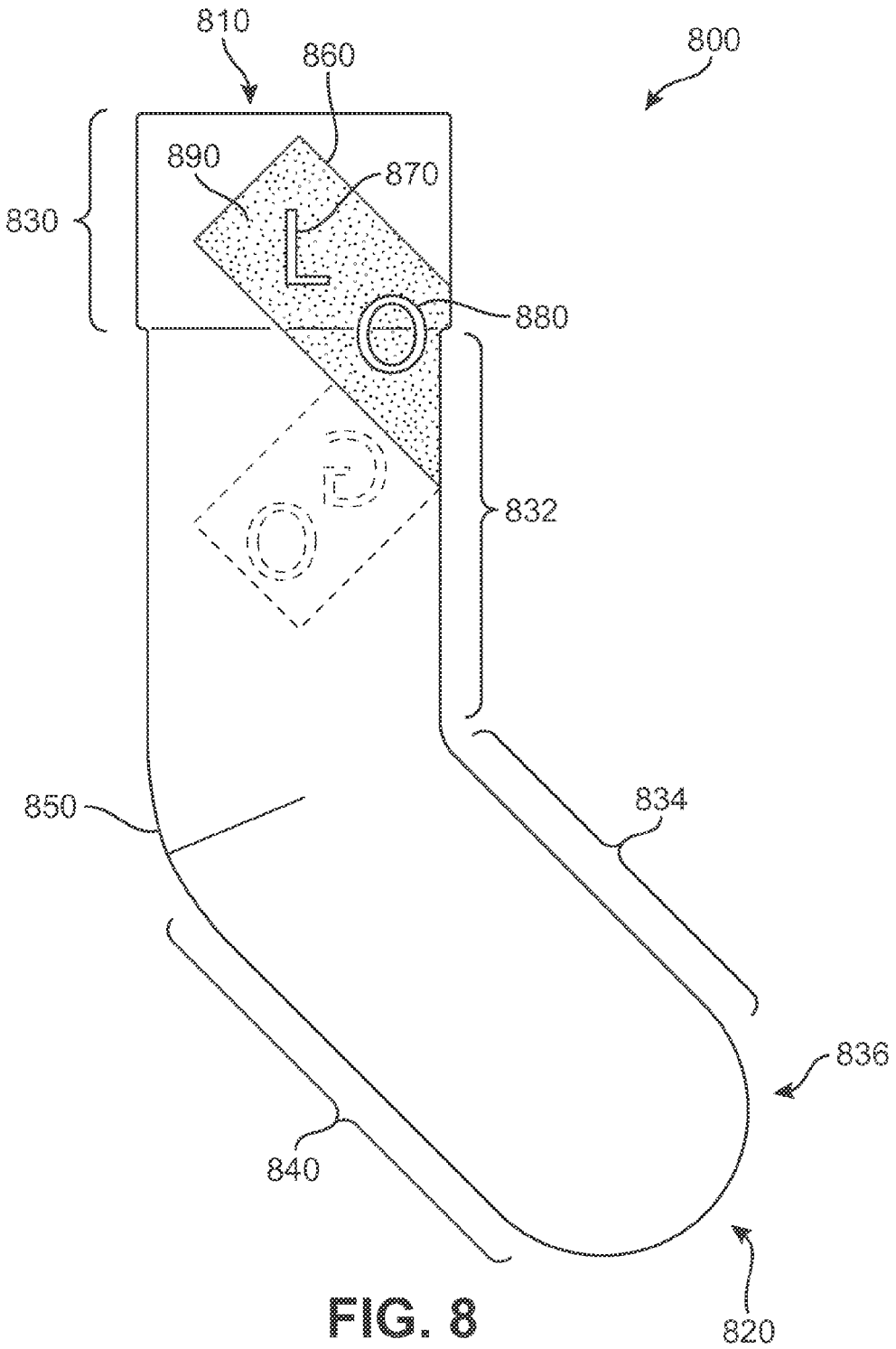
FIG. 8 is a schematic view of an embodiment of an article of apparel.

As shown in FIG. 8, in some embodiments, article 800 can take the form of a sock. However, the articles of the embodiments may generally include any articles that can be placed onto the article receptacle device 150 for printing, as described below.

In some embodiments, article 800 can include a first article end 810 and a second article end 820. In some cases, first article end 810 may be associated in the vicinity of the calf of a leg when article 800 is worn. Also, in some cases, second article end 820 may be associated in the vicinity of the toes of a foot.

In some embodiments, article 800 may include portions associated with other regions of the leg and foot when worn. In some other cases, article 800 may have portions that are also associated with thicker regions or regions with less thickness. In some other embodiments, article 800 can include a cuff portion 830, leg portion 832, instep portion 834, toe portion 836, sole portion 840, and heel portion 850.

In some embodiments, article 800 can include an indicia portion 860. Indicia portion 860, as used in this detailed description and in the claims, can refer to both singular and a plurality of markings created from the dispersion of ink from printhead 130 onto the article 800. In some cases, indicia portion 860 can include a logo 870, having a lettering portion 880, and background portion 890. In some other embodiments, indicia portion 860 may include a variety of other forms including, but not limited to: shapes, alphanumeric characters and/or other types of markings.

In some embodiments, indicia portion 860 can be associated with various portions of the article 800. In an exemplary embodiment, indicia portion 860 can be associated with the cuff portion 830 comprising thicker material, and also leg portion 832 having less material than cuff portion 830 as shown in FIG. 8.

In some embodiments, indicia portion 860 can extend around a portion of the circumference on the surface of the article 800. In some other cases, indicia portion 860 can extend along a portion of the length of article 800.

FIGS. 9-15, illustrate an embodiment of a generic process for printing on an article by printing system 100. For clarity, the following detailed description discusses an exemplary embodiment, in which printing system 100 is used to print indicia portions to an article, for example a sock.

In some embodiments, some of the following steps may be controlled by a control unit associated with printing system 100. In some other embodiments, these steps may be performed by additional systems or devices associated with printing system 100. For example, for printing systems with sensors or devices for measuring various parameters, one or more steps could be performed by the sensors or devices. In addition, in embodiments where printing system 100 is in communication with a computer (not shown), one or more steps could be performed by the computer. In addition it will be understood that in other embodiments, one or more of the following steps may be optional.

Figure 9:
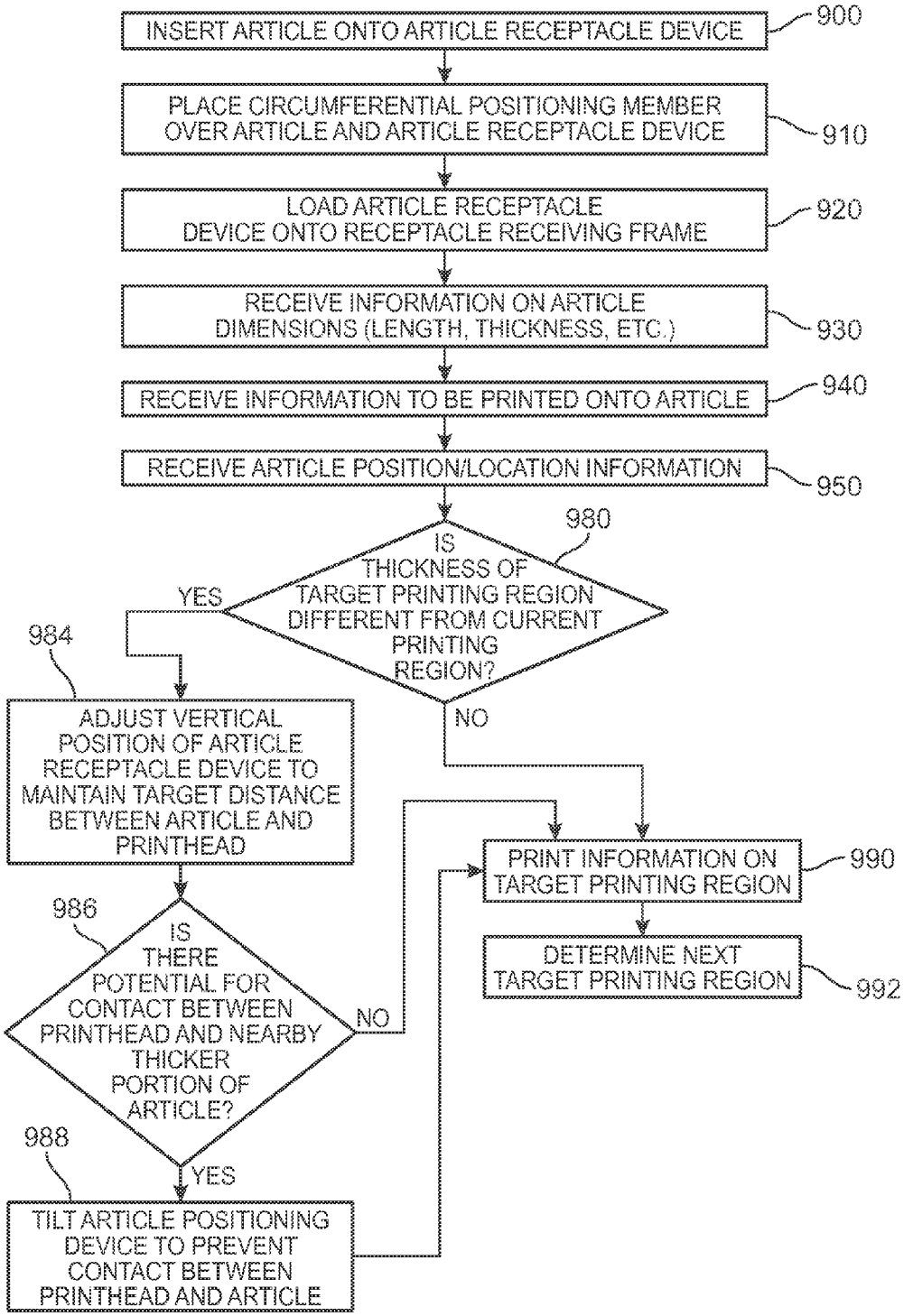
FIG. 9 is an embodiment of a process for printing on an article with varying thickness.
Figure 10:
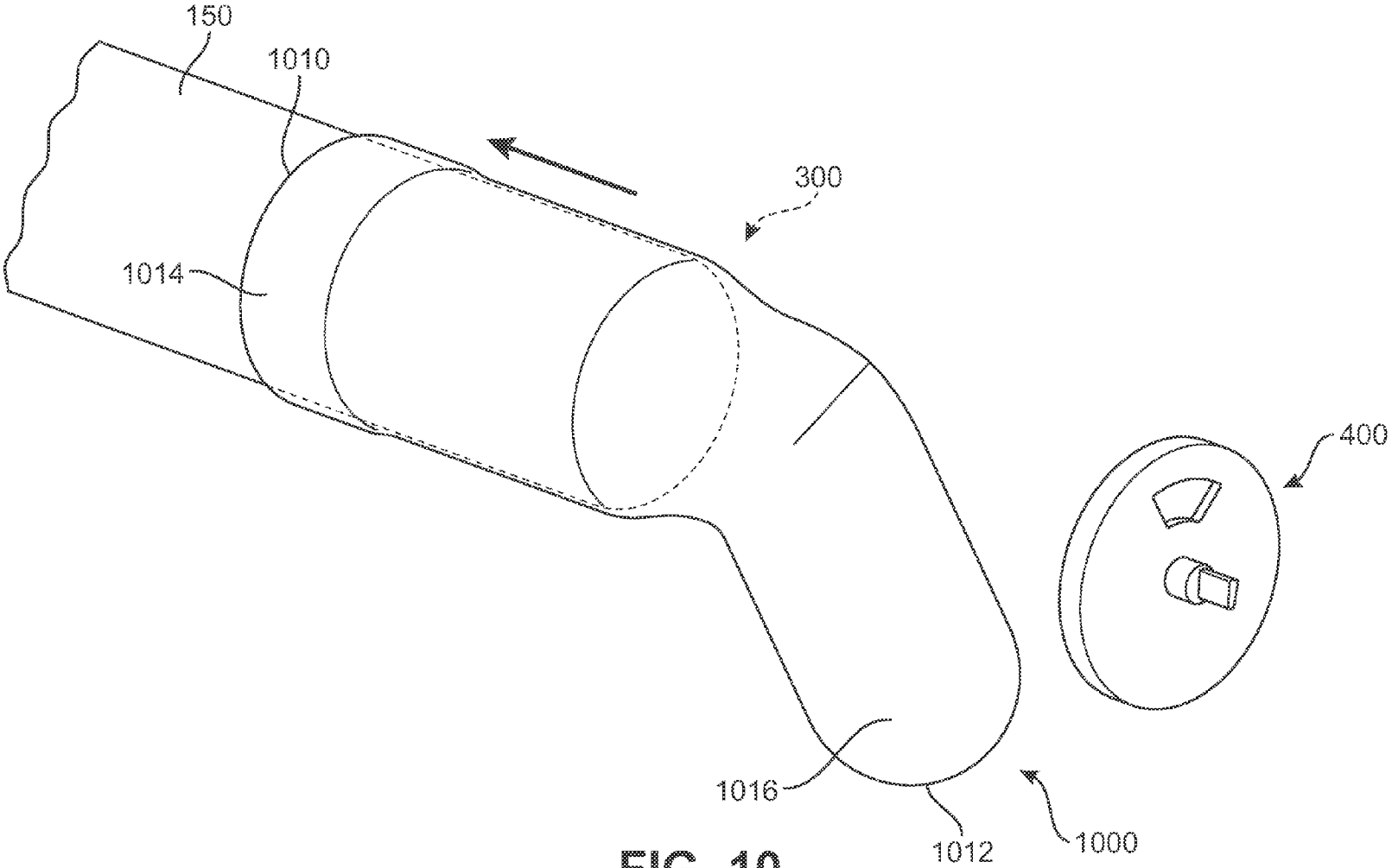
FIG. 10 is a schematic view of an article of apparel being placed onto an article receptacle device.

During step 900 in FIG. 9, an article may be inserted onto an article receptacle device 150 having a substantially cylindrical shape. As shown in FIG. 10, article 1000 could be in the form of a sock for example, similar to the sock described in FIG. 8. In some embodiments, article 1000 is first placed over article receptacle device 150 by inserting first article end 1010 in the vicinity of cuff portion 1014 over first receptacle end 300. Article 1000 may be pulled towards midpoint (not shown) of article receptacle device 150 until second article end 1012 in the vicinity of toe portion 1016 is taut against first receptacle end 300. In some embodiments, once the article 1000 is loaded onto article receptacle device 150, a circumferential positioning member 400 may be used to secure article 1000 in place.

Figure 11:
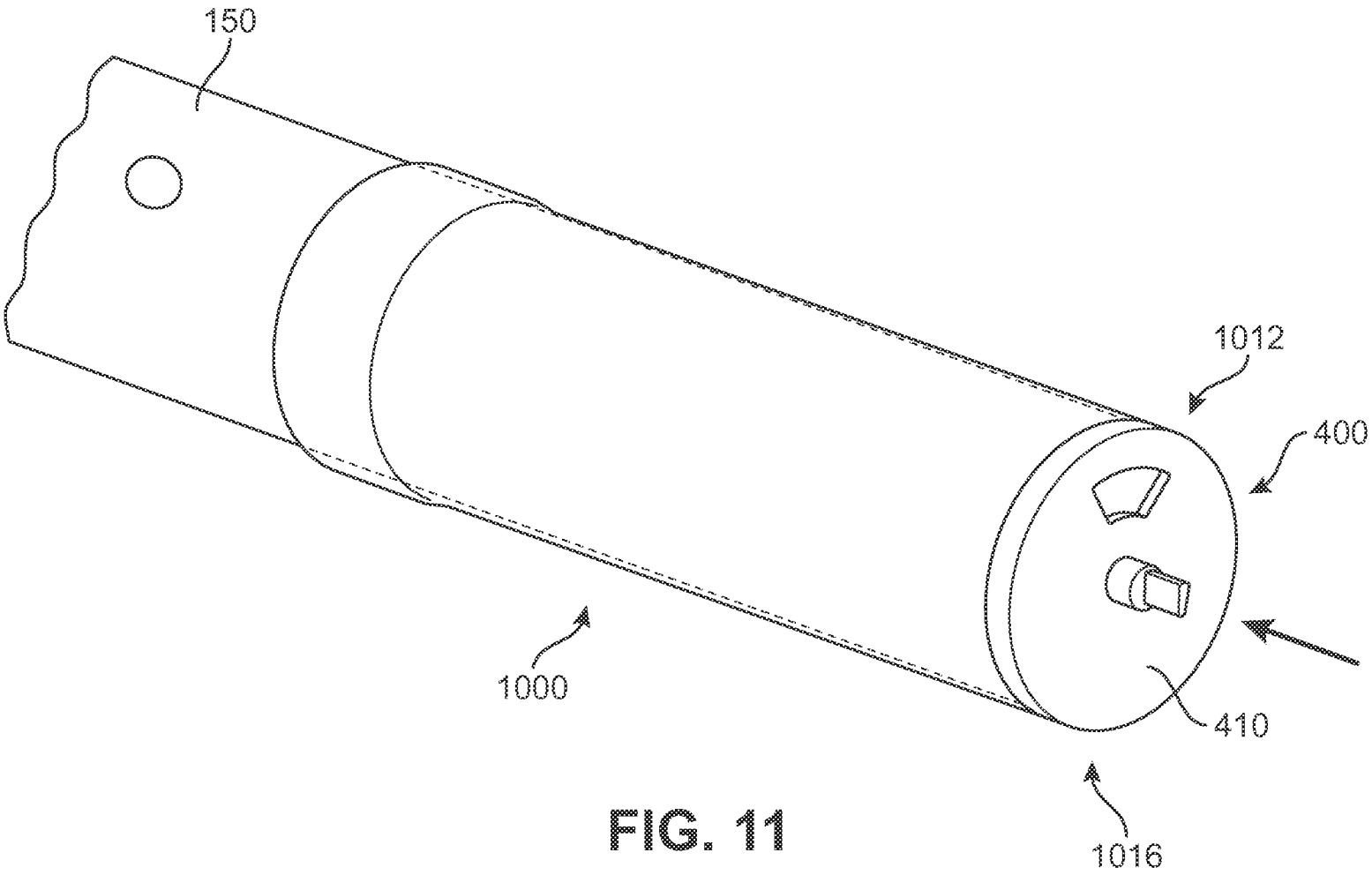
FIG. 11 is a schematic view of an embodiment of a circumferential positioning member being placed over an article of apparel loaded onto an article receptacle device.

Once the article is mounted and secured onto article receptacle device 150, an exemplary next step 910 in FIG. 9, and as illustrated in FIG. 11, includes securing article 1000. In some embodiments, article 1000 maybe secured by placing circumferential positioning member 400 over second article end 1012, such that second surface 420, opposite first surface 410, covers toe portion 1016 of article 1000.

As stated earlier, article receptacle device 150 and circumferential positioning member 400, may include devices to facilitate registration and properly align article 1000 for printing. In some cases, the use of an alignment guide and a notch member on the article receptacle device 150, with a mating tab on the circumferential positioning member 400, facilitates accurate registration and proper alignment with components of printing system 100 during use.

Figure 12:
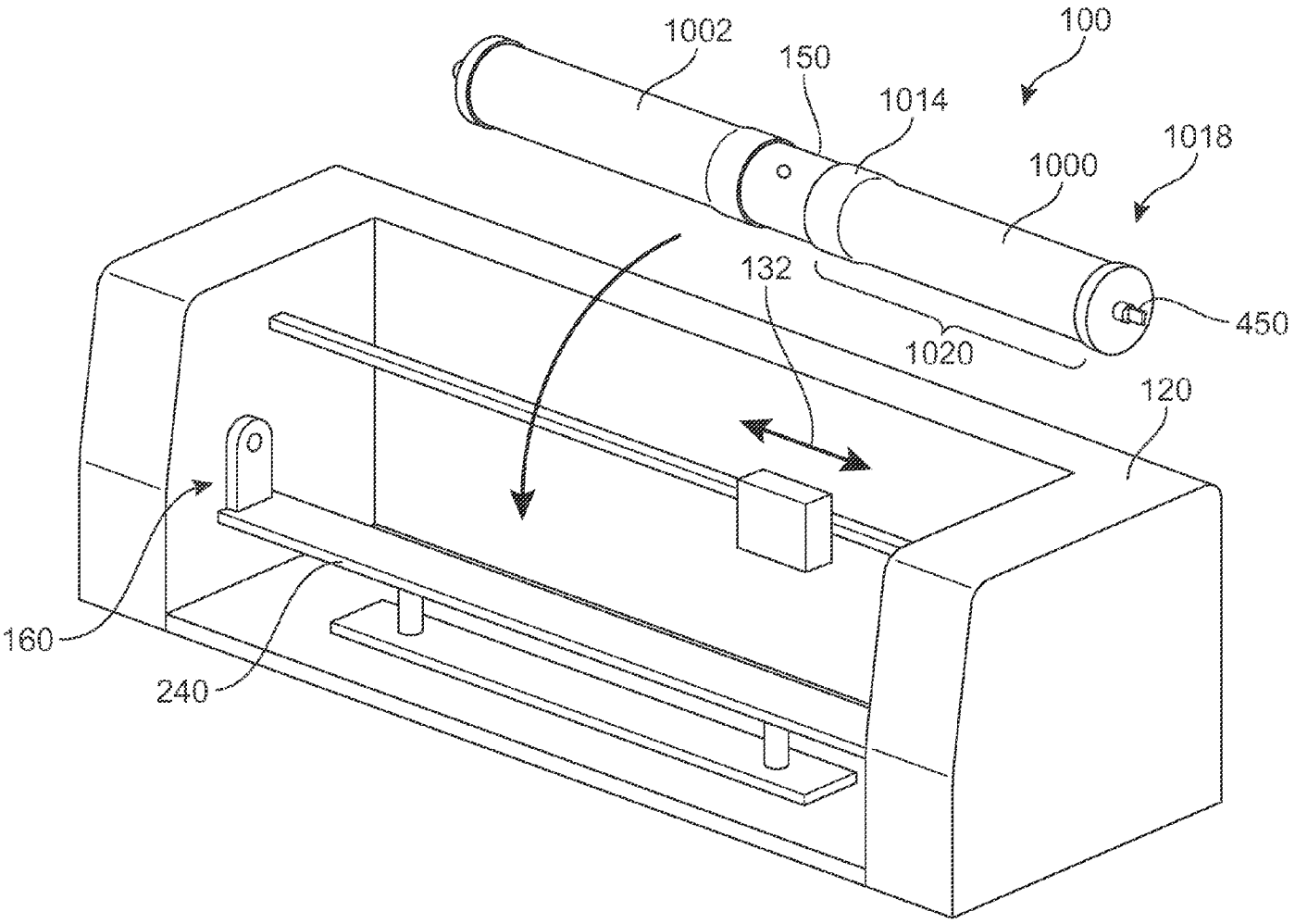
FIG. 12 is a schematic view of an embodiment of a printing system where an article receptacle device is placed onto the printing system.

FIG. 12 illustrates a schematic view of printing system 100 for exemplary step 920 in FIG. 9. In some embodiments, article 1000 may be mounted onto article receptacle device 150, and loaded onto printing system housing portion 120 for printing. In some embodiments, a second article 1002 may also be mounted onto article receptacle device 150 for printing. In some embodiments, article receptacle device 150 may be placed onto the receptacle receiving frame 240 of the receptacle receiving system 160. As illustrated previously in FIG. 6, in some cases, a connection is made by inserting alignment positioning portion 450 of circumferential positioning member 400 onto components of receptacle receiving system 160.

In some embodiments, once article receptacle device 150 is secured onto receptacle receiving system 160, a control unit of printing system 100 may receive information concerning article 1000 as indicated in FIG. 9 step 930. In some embodiments, the information may include article dimension information. For example, the article dimension information may include the longitudinal length 1020 of an article 1000 or concerning the circumferential region of the article.

In some cases, article dimension information can include a thickness, if some portions are thicker than other portions, such as the cuff portion 1014 or leg portion 1018. In some embodiments, by receiving this information, printing system 100 will know when to adjust the distance between printhead 130 and surface of article 1000 in order to avoid printhead 130 from contacting the surface of article 1000. Distances between printhead 130 and article 1000 may also need to be adjusted to properly disperse ink, thus ensuring indicia portion is properly applied.

In some embodiments, after receiving article dimension information, step 940 and step 950 in FIG. 9 indicate that a control unit may receive information related to an indicia portion including but not limited to: locations of markings, types of lettering, and different colors to be applied on article 1000.

In step 980, a control unit may determine the thickness of a target portion or printing region based on information about the article received in step 930, as well as location information received during step 950. Here, the target printing region may be at a longitudinal position ahead of the printhead, i.e., a portion of the article where the printhead will soon pass over for printing. If, during step 980, the control unit determines that the thickness of the upcoming printing region is not different than the thickness of the current printing region, the control unit may proceed to step 990 where the printhead prints to the target printing region. The control unit may then determine the next target printing region in step 992, so that the process may be repeated.

If, during step 980, the control unit determines that the thickness of the article at a target printing region is different from the thickness of the article at the current printing region (i.e. the region or portion directly under the printhead), the control unit may proceed to step 984. In step 984, the control unit may adjust the vertical position of the article receptacle device to maintain a desired target distance between the article and the printhead. For example, if the target printing region is thicker than the current printing region (e.g., the target printing region is on a thicker cuff of a sock and the current printing region is on a thinner leg portion of the sock), the control unit may raise the article receptacle device by an amount that maintains the desired target distance. If the target printing region is thinner than the current printing region, the control unit may lower the article receptacle device to maintain the desired target distance.

In addition to raising and lowering the article receptacle device in the vertical direction, the control unit may be capable of tilting the article receptacle device (either using a rotational actuator or by raising or lowering each end of the article receptacle device by a different amount). Titling the article receptacle device may allow the printhead to maintain a desired target distance over a portion of an article while avoiding contact with an adjacent portion that might interfere (i.e., contact) the printhead if the article receptacle device is raised or lowered uniformly (e.g., a constant amount along its entire length).

At step 986, a control unit may determine if there is a potential for contact between a printhead and a nearby thicker portion of an article. If so, the control unit may tilt the article receptacle device during step 988, to help maintain the desired target distance with any underlying region of the article while avoiding contact between the printhead and the thicker portion of the article. Following step 988, the control unit may proceed to step 990 to continue printing. If, during step 986, there is no potential for contact or interference between the printhead and the article, the control unit may also proceed to step 990.

FIGS. 13 through 19 illustrate exemplary situations where an article has non-planar portions and/or portions of varying thickness, and where it may be necessary to tilt and/or adjust the vertical position of an article receptacle device.

Figure 13:
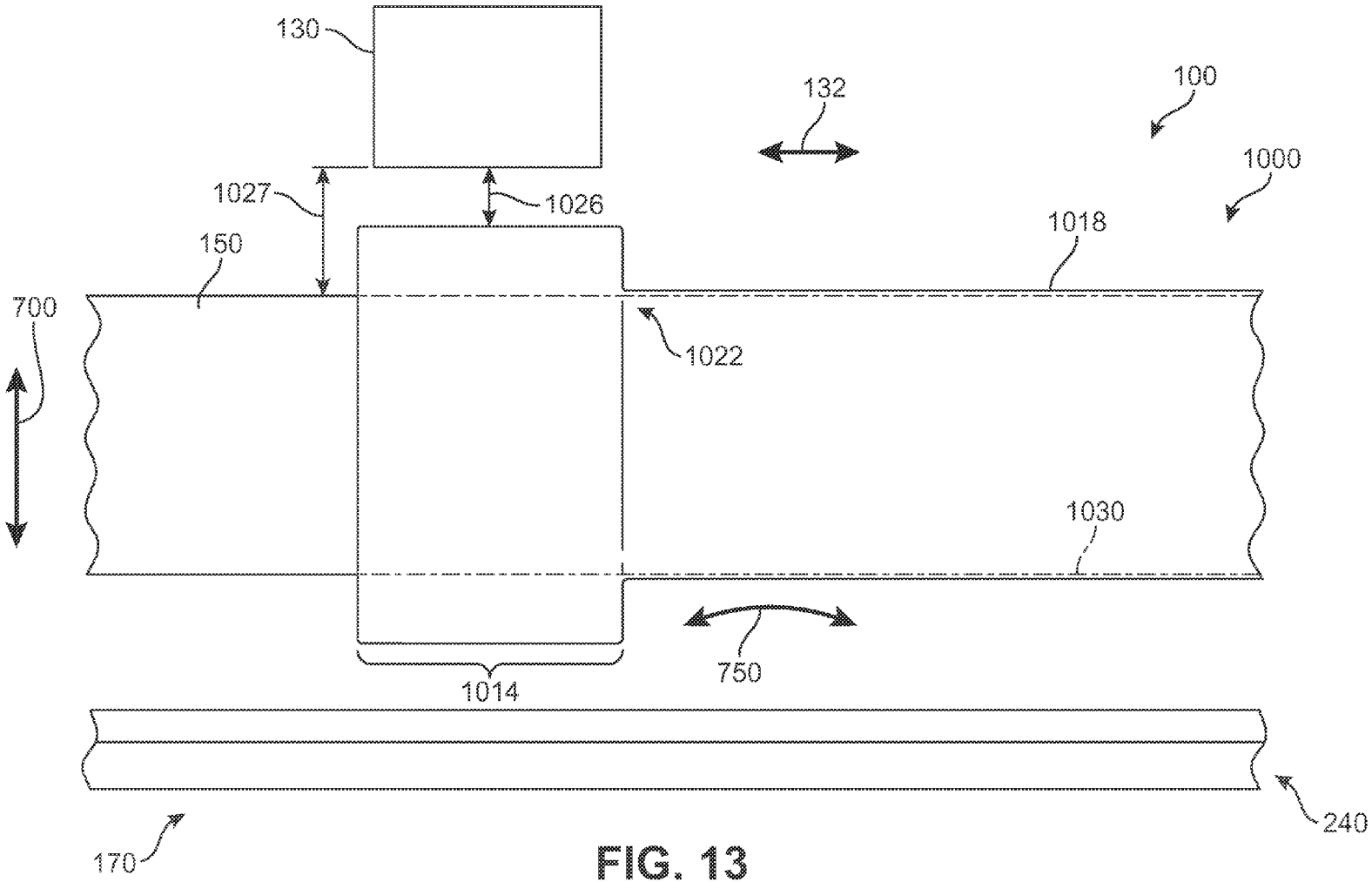
FIG. 13 is a schematic partial view of an embodiment of a printing system in which in which the printhead traverses along a longitudinal axis.
Figure 14:
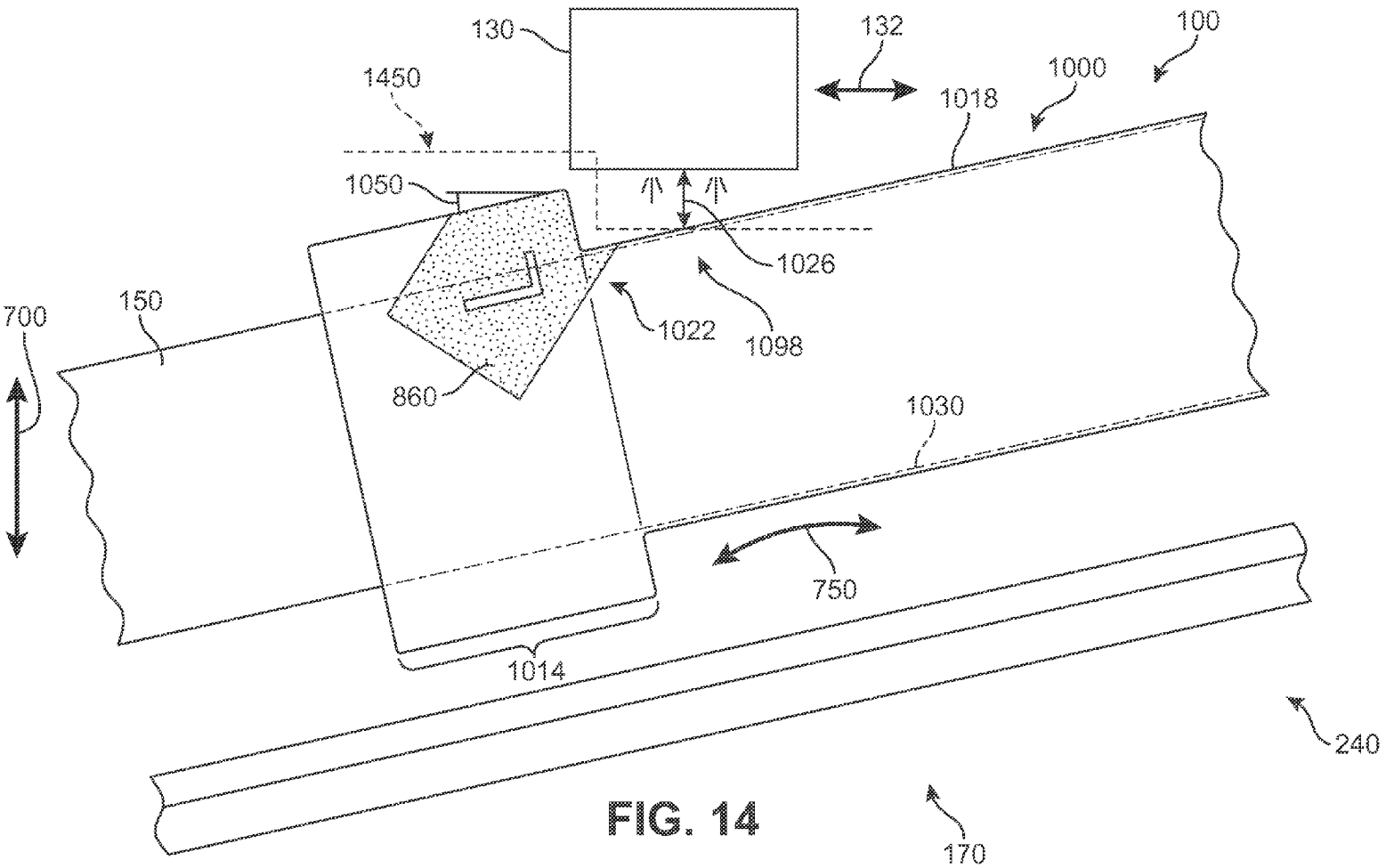
FIG. 14 is a schematic partial view of an embodiment of a printing system in which printing is done on an article of apparel with varying thickness.
Figure 15:
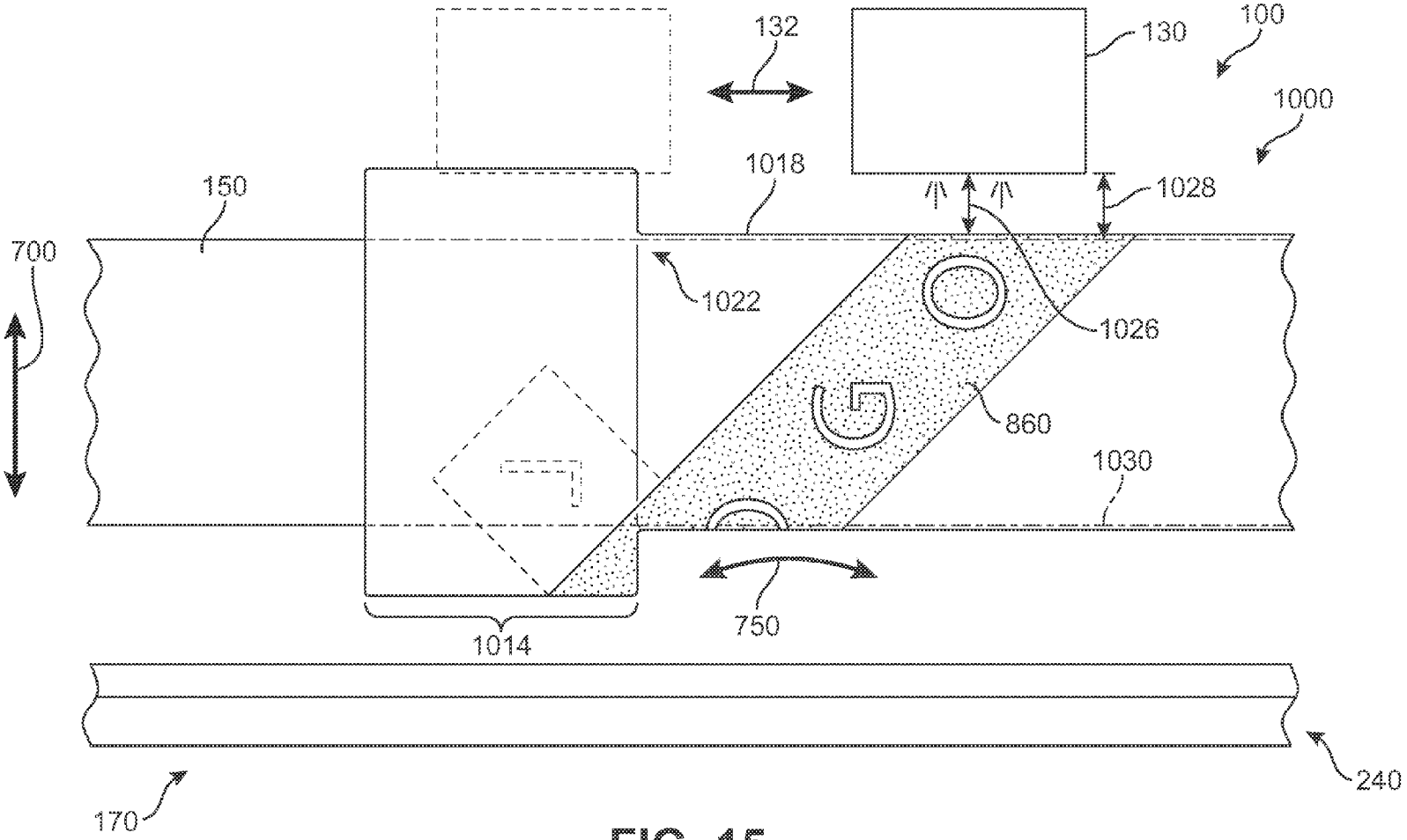
FIG. 15 is a schematic partial view of an embodiment of a printing system in which printing is done on an article of apparel with varying thickness.

FIGS. 13 through 15 illustrate an exemplary sequence in which article receptacle device 150 is tilted along tilting direction 750 to accommodate differences in thickness of an article 1000 while maintaining a constant distance 1026 between an articles surface to be printed and printhead 130. In some embodiments, article 1000 may be thicker at cuff portion 1014 than at leg portion 1018 therefore requiring article receptacle device 150 be tilted by article positioning system 170 during printing.

Referring to FIG. 13, printhead 130 is disposed over cuff portion 1014 and has started to print an indicia portion 860 into article 1000. In this position over cuff portion 1014, article receptacle device 150 has a vertical position such that printhead 130 is spaced apart from cuff portion 1014 by a constant distance 1026.

Referring to FIG. 14, in some embodiments, as printhead 130 passes over transition region 1022 between cuff portion 1014 and leg portion 1018, article receptacle device 150 may be tilted along tilting direction 750 such that one longitudinal end is higher than the opposite longitudinal end. More specifically, article receptacle device 150 may be tilted at an angle 1050 from a horizontal position such that printhead 130 and surface of article 1000 are apart by constant distance 1026 near transition region 1022 during printing.

In some embodiments, because article 1000 includes cuff portion 1014 with a different thickness than leg portion 1018, printing system 100 may need to tilt receptacle receiving frame 240 and article receptacle device 150 to avoid printhead 130 contacting the surface of article 1000 as printhead 130 traverses along longitudinal axis 132. Specifically, as seen in FIG. 14, tilting article receptacle device 150 (and article 1000 with it) allows printhead 130 to maintain the desired constant distance 1026 with target printing region 1098 while preventing interference (i.e., contact) between printhead 130 and cuff portion 1014. For purposes of clarity, the un-tilted position 1450 of cuff portion 1014 of article 1000 is shown in FIG. 15 to indicate the potential interference between printhead 130 and cuff portion 1014 that may be avoided by tilting article receptacle device 150. The ability to tilt article receptacle device 150 along tilting direction 750 facilitates a smoother transition between portions having different thickness thereby providing the best printing performance.

In FIG. 15, upon passing over transition region 1022, article receptacle device 150 may be tilted back along tilting direction 750 to a horizontal configuration and simultaneously raised along vertical axis 700 by components of article positioning system 170 such that printhead 130 and the underlying portion of article 1000 may be held approximately at constant distance 1026 across portions of article 1000 with different thickness and/or geometries.

As printing system 100 continuously prints indicia portion 860 on article 1000 surface, FIG. 15 illustrates printhead 130 further axially advanced along longitudinal axis 132 in a direction away from cuff portion 1014. From its previous location at cuff portion 1014 of article 1000, printhead 130 traverses along longitudinal axis 132 to its present location around the leg portion 1018 of the article 1000 while maintaining constant distance 1026 from FIG. 14.

In some embodiments, while printhead 130 maintains a substantially constant distance 1026 from surface of article 1000, even when encountering portions of varying thickness or different geometries, registration between printing system 100 components may require a non-fixed distance between printhead 130 and the surface of article receptacle device 150. In some embodiments, the registration between printing system 100 components article receptacle device 150, circumferential positioning member 400, and article positioning system 170 provide a variable distance between surface 1030 of article receptacle device 150 and printhead 130.

As illustrated in FIGS. 13 and 15, when printhead 130 is disposed over cuff portion 1014, surface 1030 of article receptacle device 150 and printhead 130 are separated by a first vertical distance 1027. However, at a later time, when printhead 130 is disposed over leg portion 1018, surface 1030 of article receptacle device 150 and printhead 130 are separated by a second vertical distance 1028. Moreover, second vertical distance 1028 is substantially less than first vertical distance 1027, as article 1000 is substantially thinner at leg portion 1018 than at cuff portion 1014. Thus, in relatively thinner portions of article 1000, the vertical separation between article receptacle device 150 and printhead 130 may be closer to the desired constant distance 1026 which is maintained between printhead 130 and the outer surface of article 1000. Thus, given the different thicknesses of different portions of article 1000, the distance between printhead 130 and underlying surface 1030 of article receptacle device 150 may vary substantially, even as printing system 100 maintains constant distance 1026 between printhead 130 and article 1000 during printing for best printing performance.

Once printing has been completed for a specific portion of article 1000 as shown in FIG. 9 step 990, the printing system 100 will determine the next target printing region on article 1000 requiring printing as shown in step 992. In some embodiments, the process may then repeat itself until printing is completed on article 1000.

It is to be understood that while the process recited and illustrations shown in FIGS. 9 through 15 was for a single article 1000, a second article 1002 loaded on article receptacle device 150 may undergo printing consecutively with, or successively after, article 1000 has been printed with an indicia portion 860. In addition, in some embodiments, second article 1002 may not be printed with the same indicia portion 860 but may be printed with totally different markings and designs.

In some embodiments, printing system 100 may print on an article that contains surfaces which are not uniformly horizontal. In some cases, an article may contain surfaces that may not be parallel with longitudinal axis 132. In embodiments where an article's surface is not uniformly horizontal, printing system 100 may need to tilt article receptacle device 150 such that the surface to be printed is substantially horizontal to achieve best printing performance.

Figure 16:
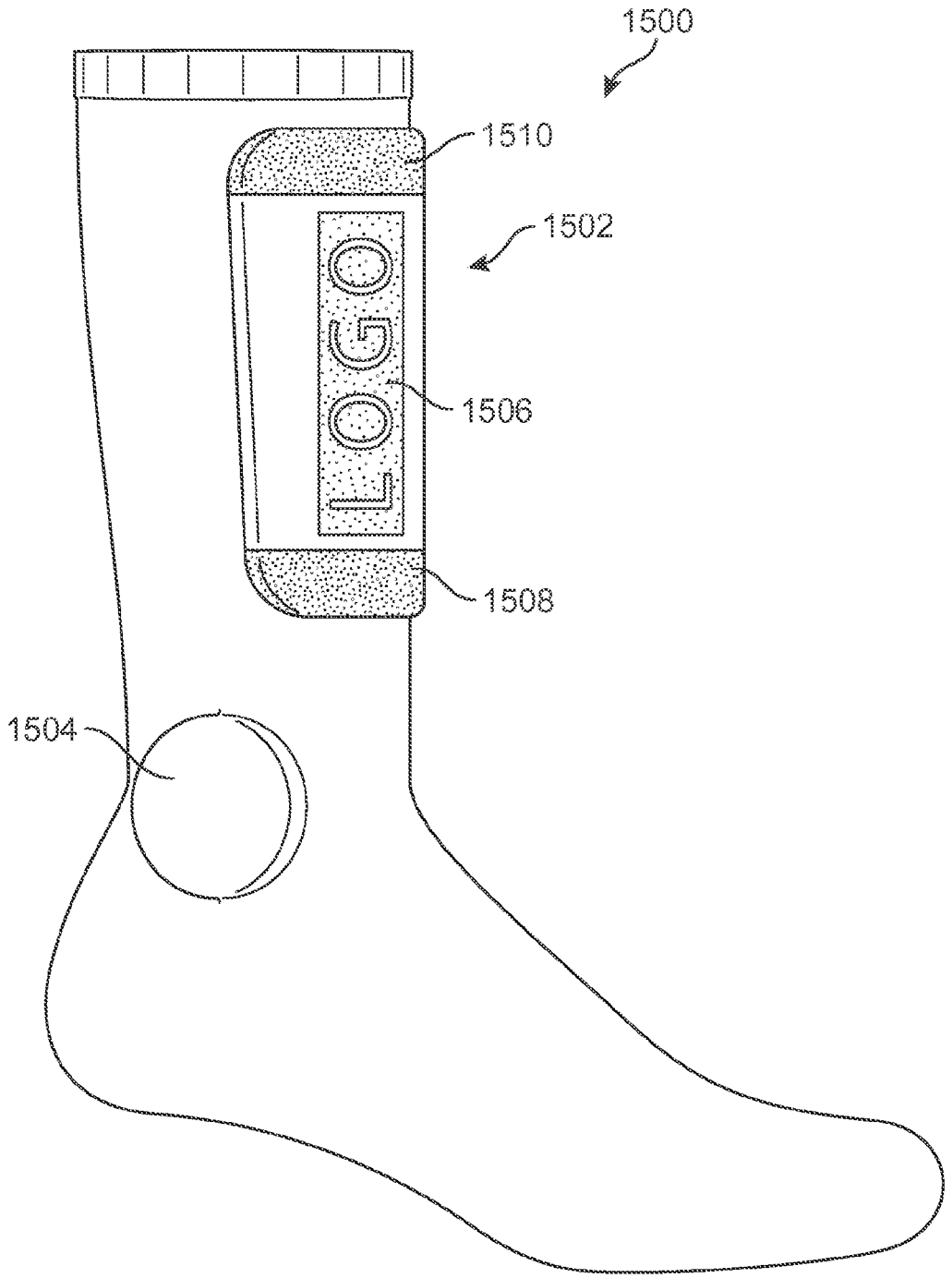
FIG. 16 is a schematic view of an embodiment of an article of apparel having printed indicia portions throughout on surfaces with varying thickness.
Figure 17:
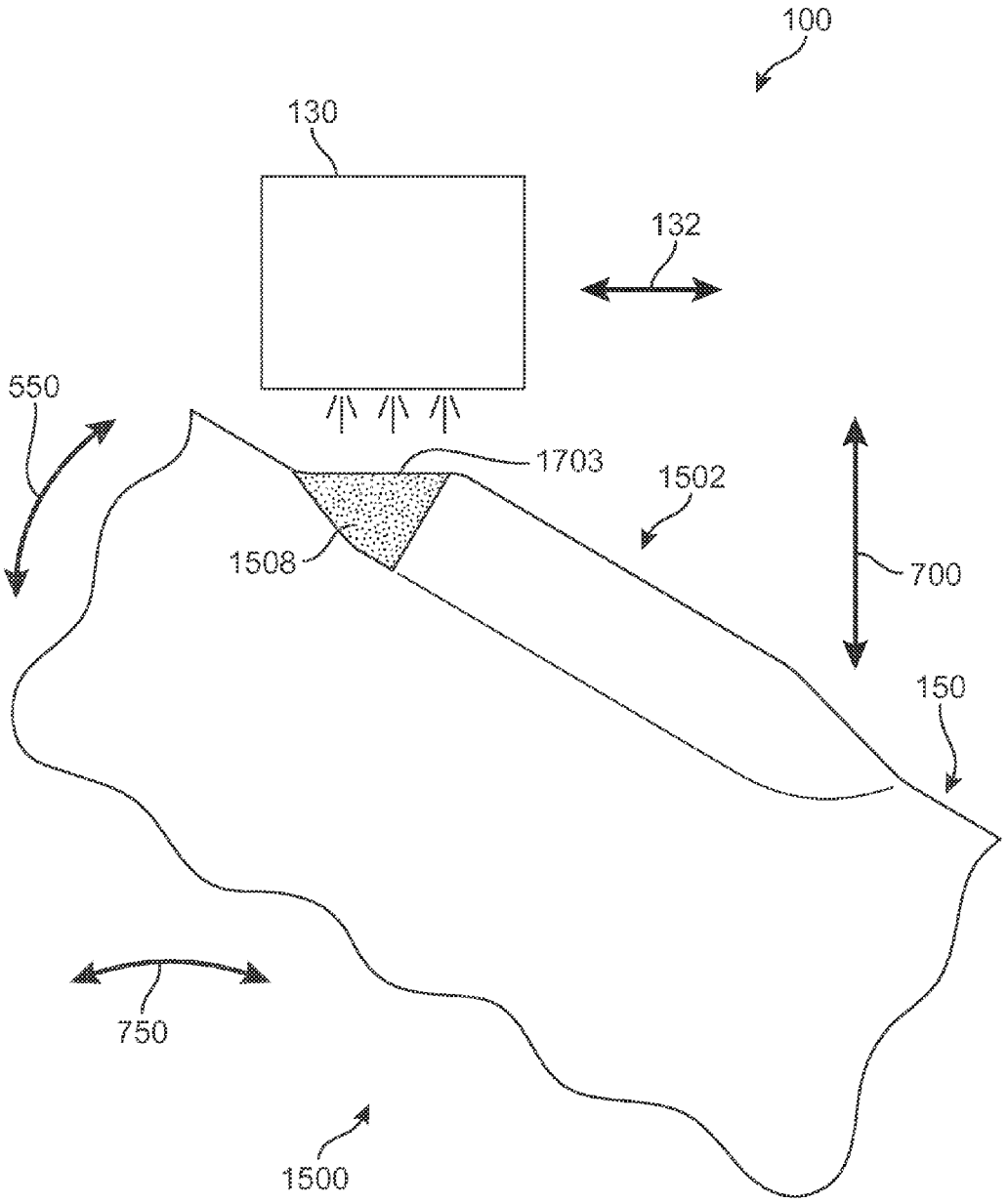
FIG. 17 is schematic partial view of an embodiment of a printing system in which printing is done on an article of apparel with varying thickness.
Figure 18:
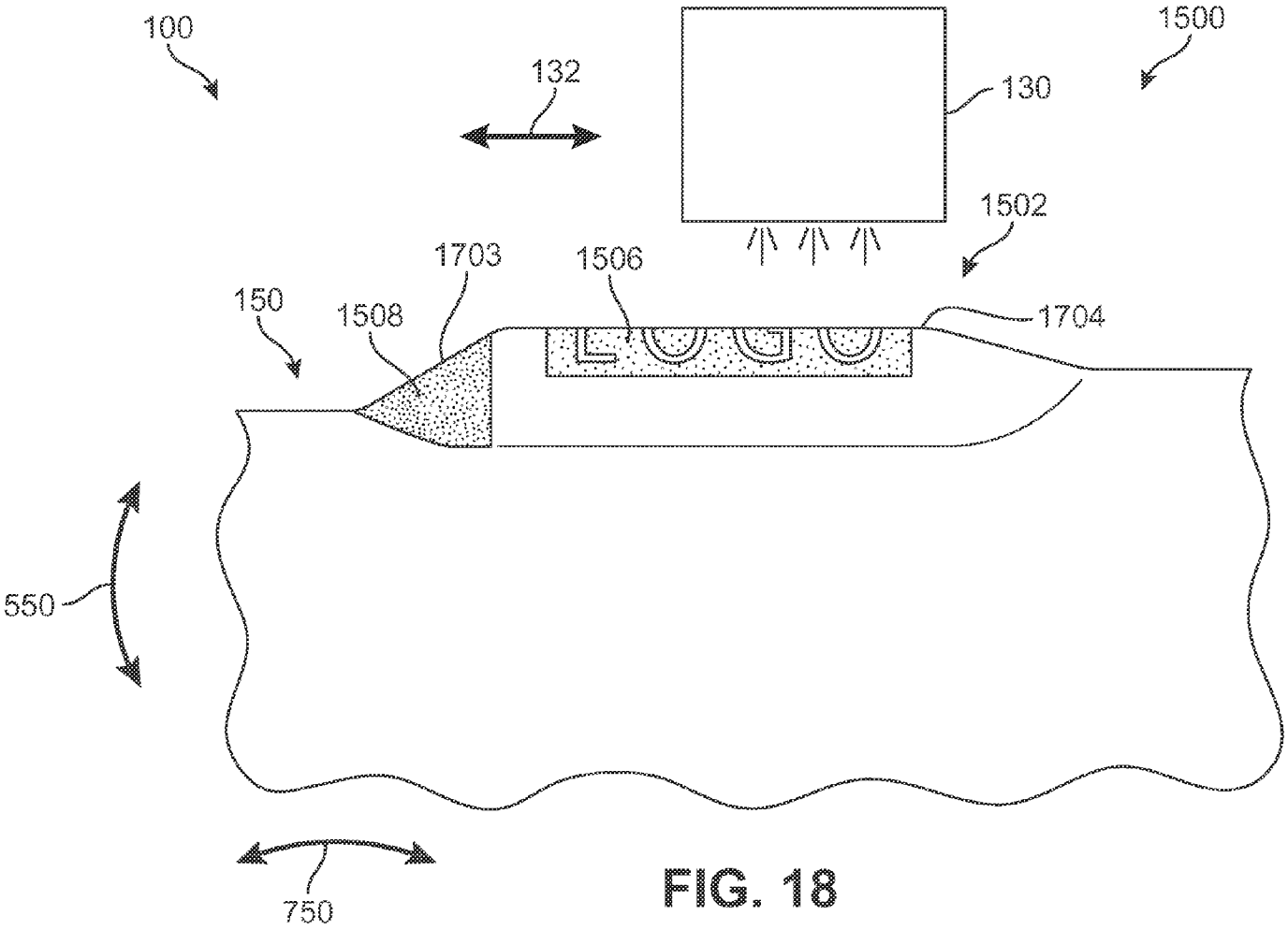
FIG. 18 is a schematic partial view of an embodiment of a printing system in which printing is done on an article of apparel with varying thickness.

FIGS. 16 through 18 depict a resulting embodiment of an exemplary article in the form of a sock 1500. In some cases, sock 1500 may include portions having a surface that is not uniformly horizontal or parallel with the surface of article receptacle device 150. Sock 1500 may include portions having various thicknesses along with pockets for placing inserts. In some cases, the sock 1500 may include a shin padded portion 1502 configured to receive an insert to protect the wearer's shin while engaged in an athletic activity. Shin padded portion 1502 may only partially encompass the circumference of the surface of the sock 1500. In still some other cases, other padded portions 1504 may be disposed on other parts of the sock 1500.

In some embodiments, shin padded portion 1502 may also have indicia portion 1506. Indicia portion 1506 may only partially encompass the circumference of the surface of the sock 1500. In some other embodiments, shin padded portion 1502 may include a first design portion 1508. In some embodiments, first design portion 1508 may partially encompass the circumference of sock 1500. In some other cases, second design portion 1510 may be present.

FIGS. 17 and 18 depict an exemplary embodiment of the printing system 100 printing indicia portion 1506 and first design portion 1508 on sock 1500. In some embodiments, in order to accommodate the non-horizontal surfaces on shin padded portion 1502, printing system 100 may need to tilt components, by tilting article receptacle device 150 along tilting direction 750, to ensure the surface for printing between printhead 130 and sock 1500 is substantially horizontal. For example, as seen in FIG. 17, article receptacle device 150 (beneath sock 1500) has been rotated so that a peripheral surface 1703 of shin padded portion 1502 is approximately parallel with printhead 130. Next, as shown in FIG. 18, article receptacle device 150 has been rotated so that central surface 1704 of shin padded portion 1502 is approximately parallel with printhead 130. Thus, even though peripheral surface 1703 and central surface 1704 are angled with respect to on another, sock 1500 can be continuously tilted during the printing process to ensure that printhead 130 and an underlying surface of sock 1500 are approximately parallel, thereby providing the best printing performance for printing on an article with varying thickness and surfaces that are not uniformly horizontal.

In some embodiments, printing system 100 can print on an article, such as a sock, an indicia portion that is continuous. In some other embodiments, printing system 100 can print an indicia portion from one article end to the other article end. In some embodiments, printing system 100 can print along the length of an article with varying thickness. In some other embodiments, printing system 100 can print extending around the entirety of a circumference on the article's surface as well.

Figure 19:
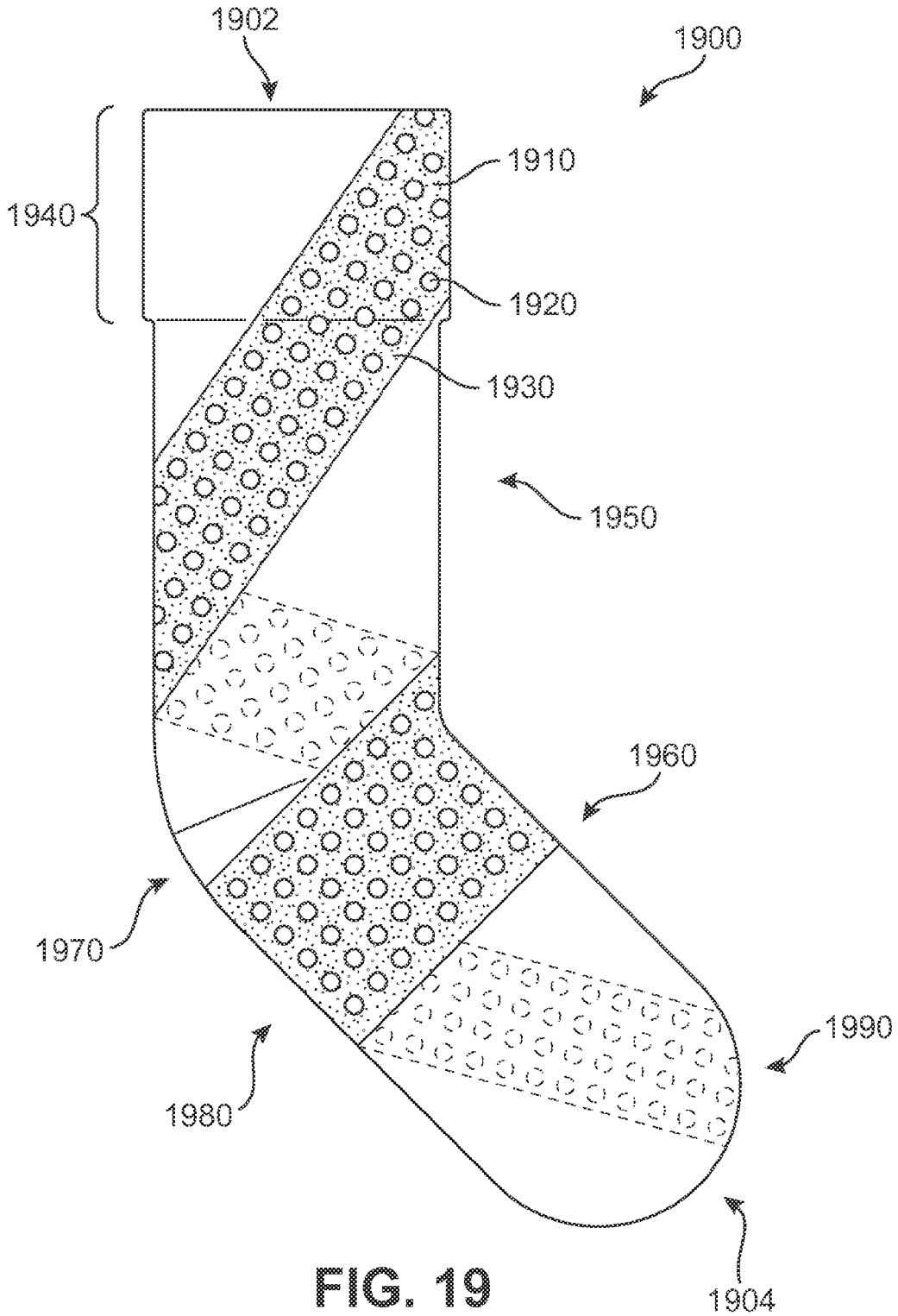
FIG. 19 is a schematic view of an embodiment of an article of apparel having printed indicia portions throughout on surfaces with varying thickness.

FIG. 19 depicts another resulting exemplary article 1900 having a first article end 1902 and second article end 1904 similar to articles previously described. In some embodiments, printing system 100 allows for an indicia portion 1910 including a design portion 1920, background portion 1930, or lettering portion (not shown) to be continuously printed onto article 1900 from first article end 1902 to second article end 1904. In some cases, indicia portion 1910 can be continuously printed along the entire length of article 1900. In some other cases, indicia portion 1910 can be continuously printed around the entirety of the circumference on the surface of article 1900.

In some embodiments indicia portion 1910 can include a cuff portion 1940 having a certain thickness. In some other embodiments, indicia portion 1910 can be continuously printed on a leg portion 1950 with a different thickness than cuff portion 1940. In some other embodiments, indicia portion 1910 can be continuously printed on instep portion 1960, heel portion 1970, sole portion 1980 and toe portion 1990, each having different thicknesses.

Figure 20:
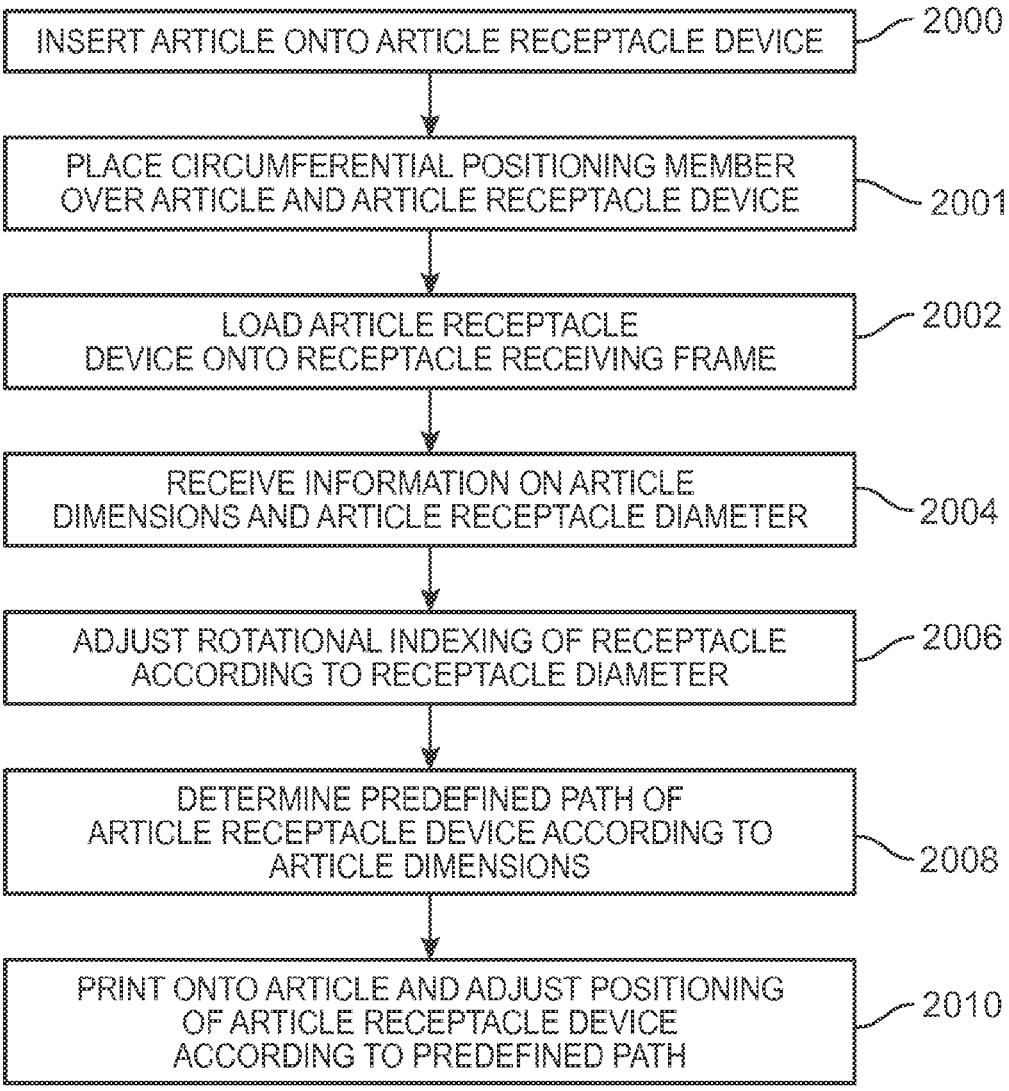
FIG. 20 is an embodiment of a process for printing on an article with varying thickness.

FIG. 20 is an embodiment of another process for printing onto an article using a printing system (e.g., printing system 100). For clarity, the following detailed description discusses an exemplary embodiment, in which printing system 100 is used to print indicia portions to an article, for example a sock.

In some embodiments, some of the following steps may be controlled by a control unit associated with printing system 100. In some other embodiments, these steps may be performed by additional systems or devices associated with printing system 100. For example, for printing systems with sensors or devices for measuring various parameters, one or more steps could be performed by the sensors or devices. In addition, in embodiments where printing system 100 is in communication with a computer (not shown), one or more steps could be performed by the computer. It is also contemplated that some steps of the following process could be accomplished by a user or operator of the system. In addition it will be understood that in other embodiments, one or more of the following steps may be optional.

During step 2000 in FIG. 20, an article may be inserted onto an article receptacle device having a substantially cylindrical shape. Once the article is mounted and secured onto the article receptacle device, an exemplary next step 2001 includes securing the article to the receptacle device. In some embodiments, the article maybe secured by a placing circumferential positioning member over an end of the article. Next, during step 2002, the article receptacle device may be loaded onto the receptacle receiving frame for printing.

At step 2004, a control unit may receive information about the dimensions of the article as well as information about the diameter of the article receptacle device. It may be appreciated that this information could be determined in any manner. In some cases, this information could be determined automatically using one or more sensors. In other cases, the information could be manually input into a computing system by a user or operator of the printing system. Moreover, the steps of gathering this information could be accomplished before the article is loaded onto the printing system or after the article has been loaded. In other words, the exemplary ordering of steps shown in FIG. 20 is not intended to be limiting.

Once the diameter of the article receptacle device has been determined, the control unit can automatically adjust the rotational indexing of the receptacle during step 2006. Specifically, the rotational indexing (e.g., how many degrees the receptacle is rotated after each pass of the print head) may be varied according to receptacle (or article) diameter. As the diameter of the receptacle increases (i.e., one receptacle is replaced by another receptacle with a larger diameter) the receptacle may be rotated through a smaller number of degrees after each printing pass of the print head. Thus, adjusting for the rotational indexing may help reduce or substantially eliminate banding or other undesirable print effects.

Following step 2006, during step 2008, the control unit may determine a predefined path of the article receptacle device according to the article dimensions (e.g., article length, thickness at various portions, etc.). As used herein, the term "predefined path" refers to a sequence of one or more parameters in time. For example, a predefined path for an article receptacle device may include a sequence of vertical positions (e.g., positions along a vertical axis) and tilting angles. Thus, for each step in time of the printing system, a particular predetermined vertical position and tilting angle of the receptacle is defined. Moreover, the values of these parameters may be determined to accommodate a corresponding predefined path for a print head in time, where the predefined path of the print head in time is a sequence of print head positions along an axis (e.g., longitudinal axis 132 in FIG. 7). Thus, the predefined path for the receptacle device may be selected so that the print head is always a desired constant distance from an adjacent printing surface on an article, and so that the print head never contacts any part of the article.

Finally, during step 2010, the system may print onto the article. During printing, the article receptacle device (and article) may be repositioned according to the predefined path found in step 2008. Thus, as the print head moves along longitudinal axis 132 to print to various portions of the article, the vertical position and tilt of the article receptacle device can be adjusted according to the predefined path to ensure that a desired print head to article spacing is maintained and that the print head doesn't contact any portions of the article.

Figure 21:
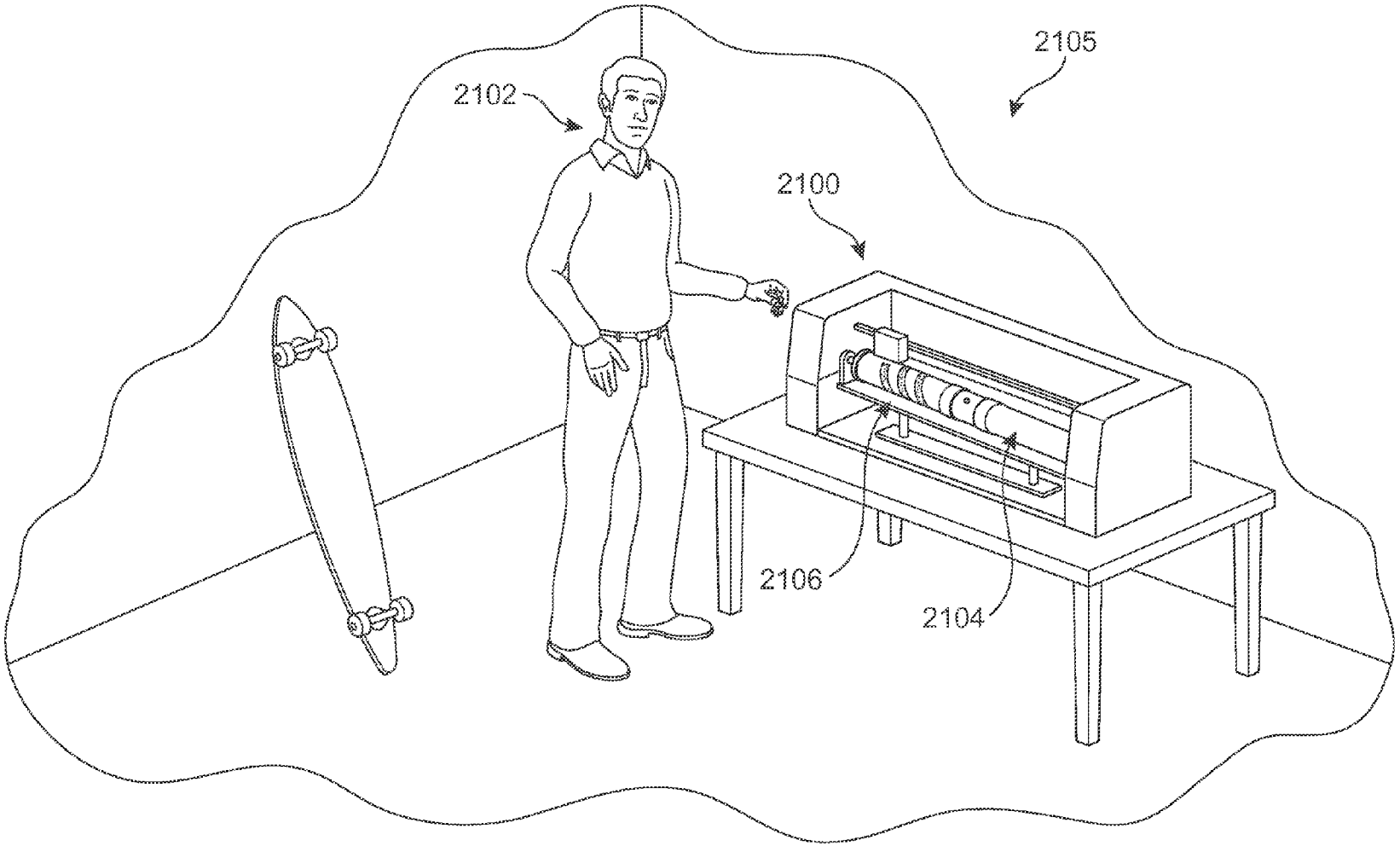
FIG. 21 is an embodiment of a mechanized process directed to printing on an article of apparel.

Some embodiments may be directed to a mechanized process for production of personalized articles of apparel. Referring to FIG. 21, in some embodiments, the process may include printing system 2100 for customizing articles purchased in-store. For example, a customer 2102 may decide to purchase articles 2104 and then further wish to have articles 2104 customized with a design or logo. In one embodiment, the customer 2102 may enter into any retail store 2105, select and purchase articles 2104, and then place articles 2104 onto the printing system 2100. The printing system 2100 will then customize articles 2104 with an indicia portion 2106 selected by customer 2102. In some embodiments, sensors or other device may be used to ensure articles 2104 are properly placed on printing system 2100.

Some embodiments can include provisions for automating one or more steps in the process for production of personalized articles. In some embodiments, a retail employee (not shown) may place non-customized articles in a display case or display table. A customer may enter and inform the retail employee of a specific size for an article to be printed. An automated retrieving device can then be used to retrieve the correct article size and place the article on the printing system for printing.

While various embodiments have been described, the description is intended to be exemplary, rather than limiting and it will be apparent to those of ordinary skill in the art that many more embodiments and implementations are possible that are within the scope of the embodiments. Any feature of any embodiment may be used in combination with or substituted for any other feature or element in any other embodiment unless specifically restricted. Accordingly, the embodiments are not to be restricted except in light of the attached claims and their equivalents. Also, various modifications and changes may be made within the scope of the attached claims.

What is claimed is:

1. A printing system, comprising:

an article receptacle device with a cylindrical geometry and an outer curved surface configured to receive an article of apparel on the outer curved surface, the article receptacle device having at least one alignment guide to facilitate positioning the article on the outer curved surface in position for printing;

an article positioning system having a first article positioning member that comprises a first linear actuator and a second article positioning member that comprises a second linear actuator, the first linear actuator being movable to adjust a height of a first portion of the article receptacle device, and the second linear actuator being movable to adjust a height of a second portion of the article receptacle device;

an alignment positioning portion extending from the article receptacle device for coupling the article receptacle device to an alignment receiving portion in an angular mating alignment relative to the at least one alignment guide, the angular mating alignment being limited to one rotational orientation;

the first article positioning member and second article position member being disposed between an article positioning base and the article receptacle device;

a printhead displaceable along a longitudinal axis;

wherein the article receptacle device has a first receptacle end and a second receptacle end and the first article positioning member is disposed closer to the second receptacle end than the second article positioning member;

wherein the first receptacle end and the second receptacle end have a same vertical position relative to a vertical axis in the horizontal configuration, the vertical axis being perpendicular to the longitudinal axis;

wherein the first receptacle end and the second receptacle end have different vertical positions along the vertical axis in the tilted configuration; and wherein the alignment positioning portion and alignment receiving portion have a mating geometry that restricts the alignment positioning portion from being received in the alignment receiving portion when the article receptacle device is in a rotational position other than the angular mating alignment.

2. The printing system according to claim 1, wherein a first distance between the article of apparel and the printhead is substantially constant during operation.

3. The printing system according to claim 2, wherein a second distance between a surface of the article receptacle device and the printhead varies during operation.

4. The printing system according to claim 1, wherein the first article positioning member moves independently from the second article positioning member so that the first receptacle end is at a first vertical position along the vertical axis, and the second receptacle end is at a second vertical position along the vertical axis; and wherein the first vertical position is different from the second vertical position in the tilted configuration.

5. The printing system according to claim 1, wherein the first article positioning member can tilt the article receptacle device so that the first receptacle end has a first vertical position along the vertical axis and the second receptacle end has a second vertical position along the vertical axis; and wherein the first vertical position is different from the second vertical position in a tilted configuration.

6. The printing system according to claim 1, wherein the article receptacle device has a first receptacle end and a second receptacle end, wherein the first receptacle end is coupled to a circumferential positioning member from which the alignment positioning portion extends, wherein the circumferential positioning member includes a mating tab portion configured to engage with a notch member in the article receptacle device in order to align the article receptacle device with the circumferential positioning member.

7. The printing system of claim 1, wherein the alignment receiving portion comprises a slotted opening and the alignment positioning portion comprises a tapered member that is configured to be removably received in the slotted opening.

8. The printing system according to claim 7, wherein the tapered member is receivable in the slotted opening in a single orientation.

* * * * *